US006914573B1

(12) United States Patent
McCorkle

(10) Patent No.: US 6,914,573 B1
(45) Date of Patent: Jul. 5, 2005

(54) ELECTRICALLY SMALL PLANAR UWB ANTENNA APPARATUS AND RELATED SYSTEM

(75) Inventor: John W. McCorkle, Vienna, VA (US)

(73) Assignee: Freescale Semiconductor, Inc., Austin, TX (US)

( * ) Notice: Subject to any disclaimer, the term of this patent is extended or adjusted under 35 U.S.C. 154(b) by 0 days.

(21) Appl. No.: 10/601,308

(22) Filed: Jun. 23, 2003

Related U.S. Application Data

(63) Continuation of application No. 10/054,790, filed on Jan. 25, 2002, now Pat. No. 6,590,545, which is a continuation-in-part of application No. 09/633,815, filed on Aug. 7, 2000, now abandoned.

(51) Int. Cl.[7] ..... H01Q 13/10
(52) U.S. Cl. ..... 343/767; 343/700 MS
(58) Field of Search ..... 343/767, 700 MS, 343/769, 829, 830, 846, 848

(56) References Cited

U.S. PATENT DOCUMENTS

| | | | | | |
|---|---|---|---|---|---|
| 4,847,626 | A | * | 7/1989 | Kahler et al. | 343/700 MS |
| 6,140,975 | A | * | 10/2000 | Cohen | 343/846 |
| 6,476,766 | B1 | * | 11/2002 | Cohen | 343/700 MS |
| 2003/0151556 | A1 | * | 8/2003 | Cohen | 343/700 MS |

* cited by examiner

*Primary Examiner*—Don Wong
*Assistant Examiner*—Huedung X. Cao
(74) *Attorney, Agent, or Firm*—Posz Law Group, PLC

(57) ABSTRACT

An electrically small, planar ultra wide bandwidth (UWB) antenna is disclosed. The antenna has a conductive outer ground area that encompasses a tapered non-conducting clearance area, which surrounds a conductive inner driven area. The feed is unbalanced with the terminals are across the narrowest part of the non-conducting clearance area which is tapered to provide a low VSWR across ultra wide bandwidths exceeding 100%. The antenna can be arrayed in 1D and 2D on a single common substrate. Amplifiers can be readily mounted at the feed.

12 Claims, 22 Drawing Sheets

ELECTRICALLY SMALL PLANAR UWB ANTENNA APPARATUS AND RELATED SYSTEM

CROSS-REFERENCE TO RELATED PATENT DOCUMENTS

This application is a continuation of U.S. patent application Ser. No. 10/054,790, filed Jan. 25, 2002 now U.S. Pat. No. 6,590,545, and entitled "Electrically Small Planar UWB Antenna Apparatus and System," which is a continuation-in-part of U.S. patent application Ser. No. 09/633,815, filed Aug. 7, 2000 now abandoned, and entitled "Electrically Small Planar UWB Antenna Apparatus and System Thereof, which is related to U.S. patent application Ser. No. 09/209,460 filed on Dec. 11, 1998 and entitled "Ultra Wide Bandwidth Spread-Spectrum Communications System," all of which are incorporated herein by reference in their entirety.

BACKGROUND OF THE INVENTION

The present invention relates generally to antenna apparatuses and systems, and more particularly, to planar antennas with non-dispersive, ultra wide bandwidth (UWB) characteristics.

With respect to the antenna of radar and communications systems, there are five principle characteristics relative to the size of the antenna: the radiated pattern in. space versus frequency, the efficiency versus frequency, the input impedance versus frequency, and the dispersion. Typically, antennas operate with only a few percent bandwidth, and bandwidth is defined to be a contiguous band of frequencies in which the VSWR (voltage standing wave ratio) is below 2:1. In contrast, ultra wide bandwidth (UWB) antennas provide significantly greater bandwidth than the few percent found in conventional antennas, and exhibit low dispersion. For example, as discussed in Lee (U.S. Pat. No. 5,428,364) and McCorkle (U.S. Pat. Nos. 5,880,699, 5,606,331, and 5,523,767), UWB antennas cover at least 5 or more octaves of bandwidth. A discussion of other UWB antennas is found in "Ultra-Wideband Short-Pulse Electromagnetics," (ed. H. Bertoni, L. Carin, and L. Felsen), Plenum Press New York, 1993 (ISBN 0-306-44530-1).

As recognized by the present inventor, none of the above UWB antennas, however, provide high performance, non-dispersive characteristics in a cost-effective manner. That is, these antennas are expensive to manufacture and mass-produce. The present inventor also has recognized that such conventional antennas are not electrically small, and are not easily arrayed in both 1D (dimension) and 2D configurations on a single planar substrate. Additionally, these conventional antennas do not permit integration of radio transmitting and/or receiving circuitry (e.g., switches, amplifiers, mixers, etc.), thereby causing losses and system ringing (as further described below).

Ultra wide bandwidth is a term of art applied to systems that occupy a bandwidth that is approximately equal to their center frequency (e.g., greater than 50% at the -10 dB points). A non-dispersive antenna (or general circuit) has a transfer function such that the derivative of phase with respect to frequency is a constant (i.e., it does not change versus frequency). In practice, this means that an impulse remains an impulsive waveform, in contrast to a waveform that is spread in time because the phase of its Fourier components are allowed to be arbitrary (even though the power spectrum is maintained). Such antennas are useful in all radio frequency (RF) systems. Non-dispersive antennas have particular application in radio and radar systems that require high spatial resolution, and more particularly to those that cannot afford the costs associated with adding inverse filtering components to mitigate non-linear antenna phase distortion.

Another common problem as presently recognized by the inventor, is that most UWB antennas require balanced (i.e., differential) sources and loads, entailing additional manufacturing cost to overcome. For example, the symmetry of the radiation pattern (e.g., azimuthal symmetry on a horizontally polarized dipole antenna) associated with balanced antennas can be poor because of feed imbalances arising from imperfect baluns. Furthermore, the balun, instead of the antenna, can limit the antenna system bandwidth due to the limited response of ferrite materials used in the balun. Traditionally, inductive baluns are both expensive, and bandwidth limiting. Furthermore other approaches used to deal with balanced antennas utilize active circuitry to build balanced (or differential) transmit/receive (TR) switches, differential transmitters, and differential receivers, in an effort to maximize the bandwidth at the highest possible frequencies. Such approaches, however, are more costly than simply starting with unbalanced antenna constructions.

Another problem with traditional UWB antennas is that it is difficult to control system ringing. Ringing is caused by energy flowing and bouncing back and forth in the transmission line that connects the antenna to the transmitter or receiver-like an echo. From a practical standpoint, this ringing problem is always present because the antenna impedance, and the transceiver impedance are never perfectly matched with the transmission line impedance. As a result, energy traveling either direction on the transmission line is partially reflected at the ends of the transmission line. The resulting back-and-forth echoes thereby degrade the performance of UWB systems. In other words, is, a clean pulse of received energy that would otherwise be clearly received can become distorted as the signal is buried in a myriad of echoes. Ringing is particularly problematic in time domain duplex communication systems and in radar systems because echoes from the high power transmitter obliterate the microwatt signals that must be received nearly immediately after the transmitter finishes sending a burst of energy. The duration of the ringing is proportional to the product of the length of the transmission line, the reflection coefficient at the antenna, and the reflection coefficient at the transceiver.

In addition to distortion caused by ringing, transmission lines attenuate higher frequencies more than lower frequencies, and sometimes delay higher frequency components more than lower frequency components (i.e. dispersion). Both of these phenomena cause distortion of the pulses flowing through the transmission line. Thus it is dear that techniques that allow shortening of the transmission line have many advantages -reducing loss, ringing, gain-tilt, and dispersion.

SUMMARY OF THE INVENTION

In view of the foregoing, there exists a need in the art for a simple UWB antenna that has an unbalanced feed, and can be arrayed in 1D and 2D on a single substrate (i.e., planar or conformal). Additionally, there is a need for a UWB antenna that is electrically small yet has low VSWR and allows the transmit and or receiving circuits to be integrated onto the same substrate to eliminate transmission line losses, dispersion, and ringing. Furthermore, there is a need for a UWB that can be mass-produced inexpensively.

Accordingly, an object of this invention is to provide a novel apparatus and system for providing an electrically small planar UWB antenna.

It is also an object of this invention to provide a novel apparatus and system for providing a UWB antenna that is inexpensive to mass-produce.

It is also an object of this invention to provide a novel apparatus and system for providing a UWB antenna that has a direct unbalanced feed that can interface to low-cost electronic circuits.

It is also an object of this invention to provide a novel apparatus and system for providing a UWB antenna that has a flat frequency response and flat phase response over ultra wide bandwidths.

It is also an object of this invention to provide a novel apparatus and system for providing a UWB antenna that exhibits a symmetric radiation pattern.

It is also an object of this invention to provide a novel apparatus and system for providing a UWB antenna that is efficient, yet electrically small.

It is also an object of this invention to provide a novel apparatus and system for providing a UWB antenna that integrates with the transmitter and receiver circuits on the same substrate.

It is also an object of this invention to provide a novel apparatus and system for providing a UWB antenna that is planer and conformal, so as to be capable of being easily attached to many objects.

It is also an object of this invention to provide a novel apparatus and system for providing a UWB antenna that does not require an active electronic means or passive means of generating and receiving balanced signals.

It is a further object of this invention to provide a novel apparatus and system for providing a UWB antenna that can be arrayed in both 1D and 2D, In which the array of UWB antennas are built on single substrate with the radiation directed in a broadside pattern perpendicular to the plane of the substrate.

These and other objects of the invention are accomplished by providing a tapered clearance area (or clearance slot) within a sheet of conductive material, where the feed is across the clearance area. A ground element, which can be made of a conductive material such copper, has a "hole" cut in it that is defined by the outer edge of the clearance area. A driven element, which is situated in the clearance area, is defined by the inner edge of the clearance area. The clearance area width at any particular point, measured as the length of the shortest line connecting the ground and the driven element, roughly determines the instantaneous impedance at that point n some embodiments of the present invention, the clearance area width is tapered to increase as a function of the distance from the feed point, so that the impedance seen at the feed, for example with a time domain reflectometer (TDR), is tapered smoothly in the time domain.

Also in some embodiments of the present invention, the clearance area width, as well as the shape of the driven element, has an axis of symmetry about the line cutting through the feed point and the point on the driven element opposite the feed point. For example, the driven element can be circular, and the ground "hole" can be a larger circle, wherein the centers are offset, such that the slot-width grows symmetrically about its minimum. The feed point is at the minimum width, in which the maximum width is on the opposite side, thus forming an axis of symmetry about the feed.

According to some embodiments of the present invention, the feed is at the minimum width. According to some embodiments, the ground "hole" is oval shaped, and the driven element is oval with a depression in the side opposite the feed element According to other embodiments, the ground "hole" is oval shaped with a bulge in the side opposite the feed element, and the driven element is oval. According to still other embodiments, the ground "hole" is oval shaped with a bulge in the side opposite the feed element, and the driven element is oval with a depression in the side opposite the feed element. An important factor is that the input impedance is tapered in the time domain in such a way as to provide the desired performance.

The antenna can be fed by connecting a coaxial transmission line to the feed point such that the shield of the coaxial cable is connected to the ground at the edge of the clearance area, and the center conductor of the coaxial cable is connected to the driven element also at the edge of the clearance area.

In some embodiments the ground element is cut to occupy only a thin perimeter so that the entire antenna is electrically small.

In order to meet these and other objects of the invention, an antenna device is provided having ultra wide bandwidth (UWB) characteristics. The antenna device includes a ground element having a cutout section with an inner circumference, the inner circumference having a first shape; and a driven element with an outer circumference having a second shape, the driven element being smaller in size than the cutout section and being situated within the cutout section to define a clearance area between the driven element and the ground element The first shape may be a first simple dosed curve having no cusps. The second shape may be a second simple closed curve having no cusps, including at least a concave portion and a convex portion. The first and second shapes may be formed such that any radial line from the center point of the driven element will intersect the first shape at a single first intersection point, and will intersect the second shape at a single second intersection point, a distance on the radial line between the first and second intersection points being defined as a clearance width between the driven element and the ground element for the radial line. The clearance area may be tapered such that a clearance width between the driven element and the ground element is monotonically nondecreasing from a minimum clearance width to a maximum clearance width.

The antenna device may further include a transmission line for providing an electrical signal to the driven element. The transmission line may be connected to a driven element at a feed point proximate to the minimum clearance width of the clearance area. The transmission line comprises a metal layer, a magnet wire, a coaxial cable, or other connection device. The transmission line may non-coplanar with either the driven element or the ground element.

The clearance area may be filled with one of FR-4, Teflon, fiberglass, or air. The ground element and the driven element may comprise a conductive material, and that conductive material may be copper.

The first and second shapes may be the same, except in different scale. The concave portion of the second shape may be formed proximate to the maximum clearance width. The driven element may have an axis of symmetry about a line that passes between the minimum clearance width of the clearance area and the maximum clearance width of the clearance area. The concave portion of the second shape may be centered on the axis of symmetry, proximate to the maximum clearance width.

An antenna device having ultra wide bandwidth (UWB) characteristics is also provided, including a ground element having a cutout section with an inner circumference, the inner circumference having a first shape; and a driven element with an outer circumference having a second shape, the driven element being smaller in size than the cutout section and being situated within the cutout section to define a clearance area between the driven element and the ground element The first shape may be a first simple closed curve having no cusps, including at least a concave portion and a convex portion. The second shape may be a second simple closed curve having no cusps, including at least a concave portion and a convex portion. The first and second shapes may be formed such that any radial line from the center point of the driven element will intersect the first shape at a single first intersection point, and will intersect the second shape at a single second intersection point, a distance on the radial line between the first and second intersection points being defined as a clearance width between the driven element and the ground element for the radial line. The clearance area may be tapered such that a clearance width between the driven element and the ground element is monotonically nondecreasing from a minimum clearance width to a maximum clearance width.

The antenna device may further include a transmission line for providing an electrical signal to the driven element The transmission line may be connected to a driven element at a feed point proximate to the minimum clearance width of the clearance area. The transmission line comprises a metal layer, a magnet wire, a coaxial cable, or other connection device. The transmission line may non-coplanar with either the driven element or the ground element.

The clearance area may be filled with one of FR-4 Teflon, fiberglass, or air. The ground element and the driven element may comprise a conductive material, and that conductive material may be copper.

The first end second shapes may be the same, except in different scale. The concave portion of the second shape may be formed proximate to the maximum clearance width. The driven element may have an axis of symmetry about a line that passes between the minimum clearance width of the clearance area and the maximum clearance width of the clearance area. The concave portion of the second shape may be centered on the axis of symmetry, proximate to the maximum clearance width.

With these and other objects, advantages and features of the invention that may become hereinafter apparent, the nature of the invention may be more dearly understood by reference to the following detailed description of the invention, the appended claims and to the several drawings herein.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
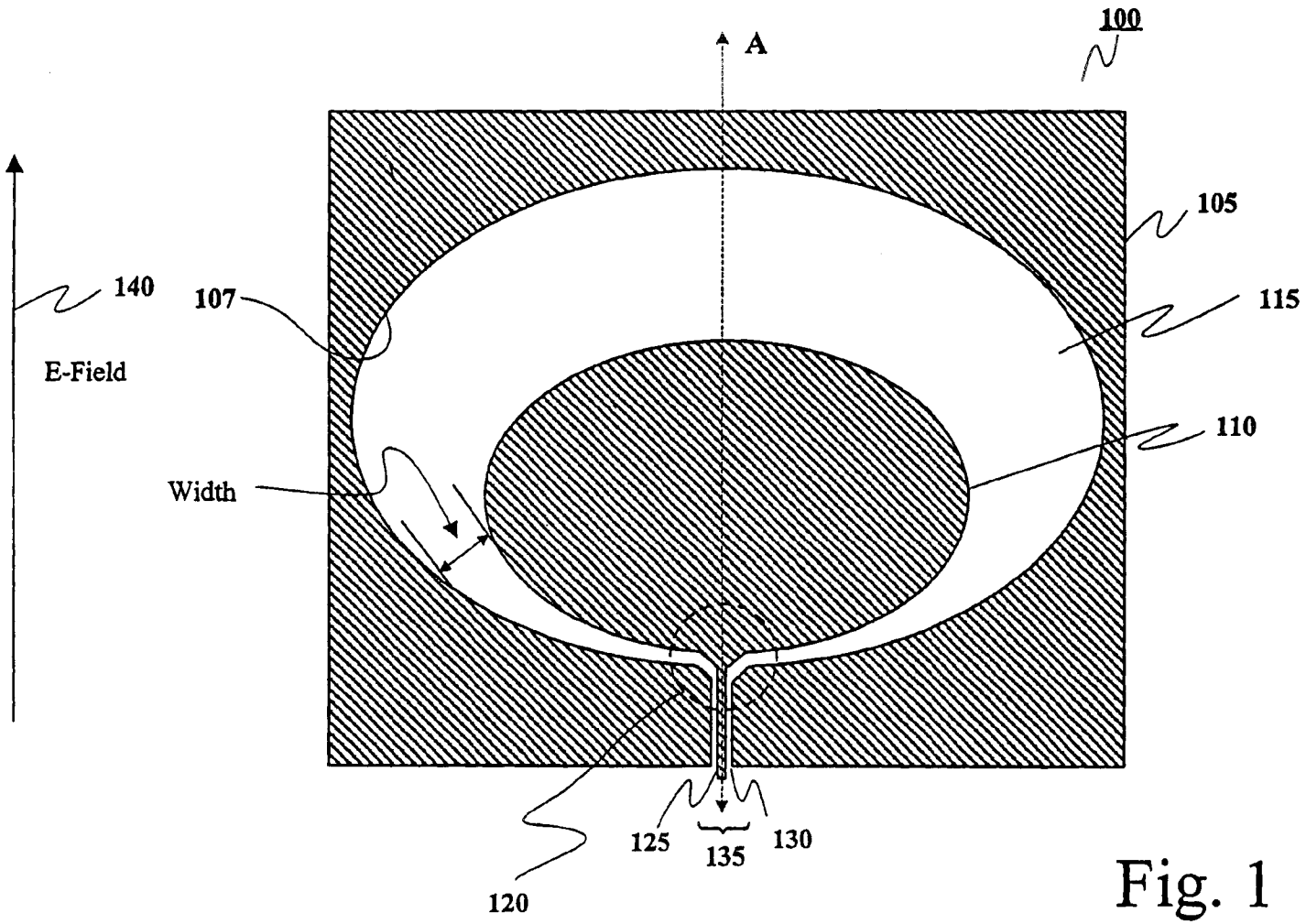
FIG. 1 is a diagram of a UWB antenna according to a preferred embodiment of the present invention having an oval shape.

Referring now to the drawings, specific terminology will be employed for the sake of clarity. However, the present invention is not intended to be limited to the specific terminology so selected and it is to be understood that each of the elements referred to in the specification are intended to include all technical equivalents that operate in a similar manner. In addition, elements referred to by corresponding numbers, e.g., those that share the last two digits such as 105, 305, . . . , 2005, etc. are intended to refer to similar elements in the different embodiments.

Referring now in detail to the drawings, FIG. 1 is a diagram of a UWB antenna according to an embodiment of the present invention. As seen in FIG. 1, the antenna 100 has a ground element (i.e., a ground plane) 105, a driven element 110, a tapered clearance area 115 between the ground element 105 and the driven element 110, a feed point 120, a transmission line 125, and an antenna input 135.

In this embodiment the ground element 105 has a simple oval or elliptical cutout section having an inner circumference 107; the driven element 110 has an oval shape with an area that that is smaller than the area of the cutout section of the ground element 105. The ground element 105 is preferably cut to occupy only a thin perimeter so that the antenna 100 is electrically small.

The inner circumference 107 of the cutout section of the ground element 105 is broken by the antenna input 135, and the circumference of the driven element 110 is broken by the transmission line 125.

The driven element 110 and the ground element 105 are preferably formed from any conductive material (e.g., copper). They can be formed on a common plane (or conformal surface) or can be slightly offset, such as the top and bottom of a printed circuit (PC) board.

The driven element 110 is placed inside the cutout section of the ground element 105, off center with the cutout section, to form the tapered clearance area 115. The tapered clearance area 115 is preferably symmetrically tapered about the axis A, which passes through the feed point 120. The resulting clearance area 115 resembles a tapered "doughnut" shape. Both the driven element 110 and the cutout section of the ground element 105 preferably have an axis of symmetry about the feed point 120 (i.e., axis A).

The tapered clearance area 115 is preferably non-conductive. This can be, for example, a non-conductive solid such as Teflon or FR-4, or open air.

In alternate embodiments, however, the shape of the cutout section and the driven element 110 can be designed in accordance with the desired application. As a result, the ultimate shape of the tapered clearance area 115 can take many forms, of which a few are discussed herein. Generally the clearance area 115 will be monotonically nondecreasing from the feed point 120 to a point opposite the feed point, i.e., it cannot ever reduce in width as it passes from the feed point 120 to the point opposite the feed point. For the purposes of this discussion, the width of the tapered clearance area 115 is the length of the shortest line connecting the ground element 105 to the driven element 110. In alternate embodiments the taper may not be monotonic in order to create band-rejected regions or otherwise taper the antenna transfer function.

The feed point 120 is preferably located across the narrowest gap between the ground element 105 and the driven element 110. In other words, the feed point 120 is located where the clearance area 115 has a minimum width.

The antenna 100 is driven with the transmission line 125, which is attached to the driven element 110. In the embodiment disclosed in FIG. 1, the transmission line is a coplanar metal layer formed on a PC board. However, in alternate embodiments the transmission line could be a magnet wire, a coaxial cable, a line laid over the ground plane, a twin-lead line, a twisted pair line, or any other desired transmission medium.

In the embodiment shown in FIG. 1, the transmission line 125 is coplanar with both the driven element 110 and the ground element 105. As a result a gap 130 is formed in the ground element 105 to allow the transmission line 125 to pass. In alternate embodiments where the transmission line 125 and the ground element 105 are not co-planar, no such gap 130 in the ground element 105 is required.

The transmission line 125 can provide a signal to the driven element 110 in a variety of ways. In the embodiment shown in FIG. 1, the transmission line 125 is directly connected to the driven element 110 by a set of linear connectors. However, alternate connections are possible. For example, the connection could be a curved metal line, a solder connection, etc, as would be well known in the art. These connections could be direct connections that are either coplanar or non-coplanar, or could be indirect connections where the transmission line couples the signal through proximity to the driven element 110.

The width of the clearance area 115 is tapered according to the function of the distance to the feed point 120 so as to form a smooth impedance transition, as measured, for example, by a time-domain-reflectometer (TDR). In an exemplary embodiment, a transmission line with characteristic impedance $Z_0$, (e.g., standard 50 ohms), connects to driven element 110 In which case, the clearance width at the feed is made so that its impedance is $2\times Z_0$ (e.g., 100 ohm) to the right side and to the left side. The right side and left side slots, being in parallel at the feed connection, combine to provide a $Z_0$ impedance (e.g., 50 ohm) load to energy flowing down the transmission line.

As the clearance width increases, the impedance increases. The taper on the clearance width is designed to obtain the desired bandwidth and VSWR parameters. At low frequencies, the antenna 100 becomes an open circuit. In alternative embodiments, a high impedance load is placed across the slot in order to discharge static, if necessary. The bottom center of the antenna 100 constitutes an antenna input 135.

The antenna 100 has two terminals; one terminal is the input 135 to the co-planar transmission line 125, which connects to the driven element 110. The second terminal is the ground element 105. As shown in FIG. 1, the antenna 100, in its fundamental EM mode, generates or receives an electric field (E-field) in the direction of the arrow 140. The antenna 100, thus, has an unbalanced feed, which advantageously negates the need for baluns, which may limit the effective bandwidth of the antenna 100.

The antenna 100 may be formed on a PC board using common PC board construction techniques, which are well known in the art. In the alternative, the antenna may be formed using conductive sprays or films on non-conductive housings so that the integrated antenna can be manufactured at very low cost. In the preferred embodiment the antenna 100 is flat, such as when it is placed on a PC board. Alternatively, however, the antenna 100 could be placed on a curved surface.

Regardless of the shape of the surface the antenna 100 is placed on, the radiation of the antenna 100 is perpendicular to this surface. This radiation pattern is in contrast to the other UWB antennas, which exhibit radiation in the plane (i.e., parallel) of the surface, such as that of Lee (U.S. Pat. No. 5,428,364). The perpendicular radiation pattern of antenna 100 advantageously permits the creation of 1-dimensional and 2-dimensional arrays of the antenna 100 onto a common substrate, thus affording high gain and directivity over ultra wide bandwidths, with simple and inexpensive yet mechanically precise and stable construction.

These arrays can be fed using, for example, a network of coplanar lines, or a network of microstrip or stripline lines on a PC board with each element fed, possibly through a via, to the feed point 120 on the driven element 110. By setting appropriate line lengths between elements, the beam pattern can be steered away from broadside. By using electronically controlled delay lines or phase shifters in the feed network, the array can be made to have a beam that is electronically steered. Thus the antenna 100 is useful in making large arrays built on a single common substrate.

Arrays of inverted and non-inverted elements (i.e. those rotated 180 degrees from each other) can be implemented with multiple copies of the antenna 100, connected, for example, to a feed network using with 0 and 180 degree phase shifts to make broadside patterns. Dual polarization arrays can be made with elements rotated 90 degrees (e.g. horizontally polarized) connected to second network (e.g. horizontal feed), and the other elements connected to the first network (e.g. vertical feed).

Figure 2:
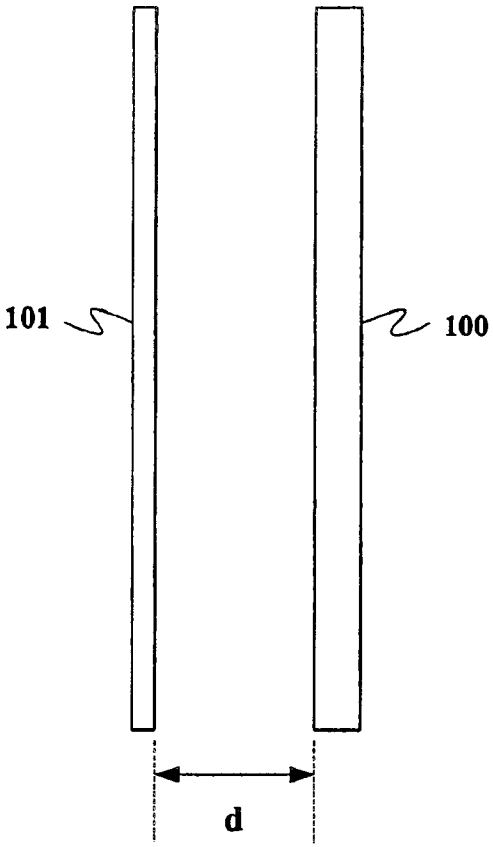
FIG. 2 is a side view of the UWB antenna of FIG. 1 with a metal plate placed behind it to increase its gain.

In addition, as illustrated in FIG. 2, to provide increased gain, a metal sheet 101 can be placed behind the antenna 100. The metal sheet 101 can be of any size and may be made of any conductive material. In an exemplary embodiment, the metal sheet 101 is of equal dimensions as the antenna 100. The distance d that the metal sheet 101 is placed behind the antenna 100 is determined by the desired impulse response.

Multiple metal sheets, each made of frequency selective surfaces (FSS) and each at a different distance may also be used to customize the antenna transfer function. Alternative embodiments could also use a driven element of a Yagi-Uda array with directors.

FIGS. 3–11 show various preferred embodiments of the present invention. Each is similar to the design shown in FIG. 1, and corresponding elements operate in a like manner, except as noted. These preferred embodiments are provided by way of example, however, and should not be interpreted as limiting the present invention. Numerous variations and combinations of these designs are expected and are considered to be within the scope of the present invention.

Figure 3:
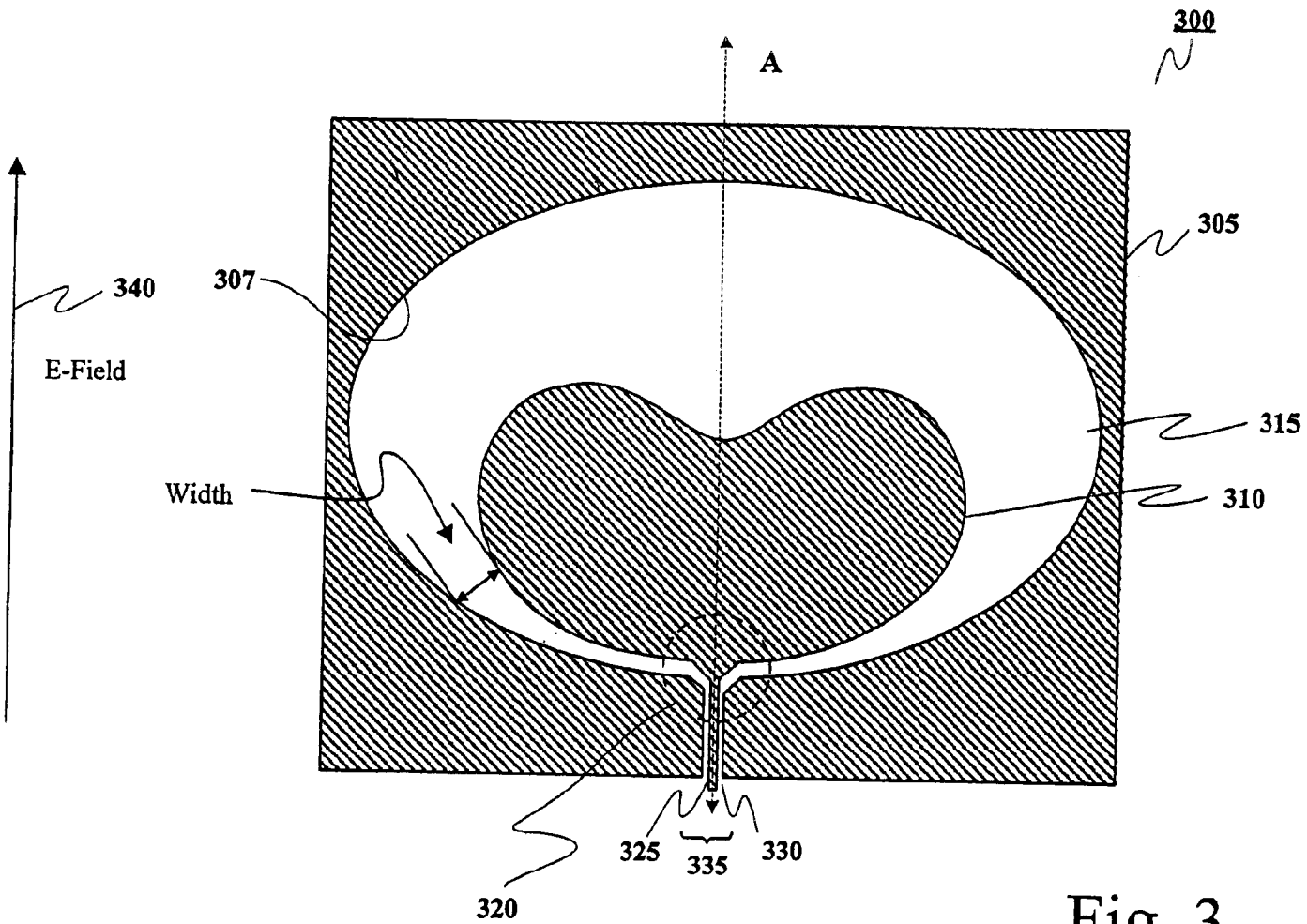
FIG. 3 is a diagram of a UWB antenna having an oval shaped driven portion with a depression in one end, fitted into an oval gap in a ground plane, according to a preferred embodiment of the present invention.

FIG. 3 is a diagram of a UWB antenna according to an alternate embodiment of the present invention. As seen in FIG. 3, the antenna 300 has a ground element (i.e., a ground plane) 305, a driven element 310, a tapered clearance area 315 between the ground element 305 and the driven element 310, a feed point 320, a transmission line 325, and an antenna input 330.

In this embodiment the ground element 305 has a simple oval or elliptical cutout section having an inner circumference 307 and the driven element 310 has an oval shape that is smaller in size than the cutout section of the ground element 305, and which also has a depression formed in it on the side farthest from the feed point 320. The ground element 305 is preferably cut to occupy only a thin perimeter so that the antenna 300 is electrically small.

The driven element 310 and the ground element 305 are preferably formed from any conductive material (e.g., copper). They can be formed on a common plane (or conformal surface) or can be slightly offset, such as the top and bottom of a printed circuit (PC) board.

The driven element 310 is placed inside the cutout section of the ground element 305 to form the tapered clearance area 315. The tapered clearance area 315 is preferably symmetrically tapered about the axis A, which passes through the feed point 320. The tapered clearance area 315 is preferably tapered such that it has a minimum width at the feed point and a maximum width at a point opposite the feed point. Both the driven element 310 and the cutout section of the ground element 305 preferably have an axis of symmetry about the feed point 320 (i.e., axis A). The tapered clearance area 315 should be non-conductive.

In alternate embodiments, however, the shape of the cutout section and the driven element 310 can be designed in accordance with the desired application. As a result, the ultimate shape of the tapered clearance area 315 can take many forms, of which a few are discussed herein. To maintain maximum bandwidth, the clearance area 315 should be limited such that it does not ever reduce in width as it passes from the feed point 320 to the point opposite the feed point. However, in alternate embodiments width reductions can be used to achieve band-stop performance when desired.

The feed point 320 is preferably located across the narrowest gap between the ground element 305 and the driven element 310. In other words, the feed point 320 is located where the clearance area 315 has a minimum width. For the purposes of this discussion, the width of the tapered clearance area 315 is the length of the shortest-line connecting the ground element 305 to the driven element 310.

The antenna 300 is driven with the transmission line 325, which is preferably coplanar with and attached to the driven element 310. In the embodiment disclosed in FIG. 3, the transmission line is a metal layer formed on a PC board. However, in alternate embodiments the transmission line could be a magnet wire, a coaxial cable, a line laid over the ground plane, a twin-lead line, a twisted pair line, or any other desired transmission medium.

In the embodiment shown in FIG. 3, the transmission line 325 is coplanar with both the driven element 310 and the ground element 305. As a result a gap 330 is formed in the ground element 305 to allow the transmission line 325 to pass in alternate embodiments where the transmission line 325 and the ground element 305 are not coplanar, no such gap 330 in the ground element 305 is required.

The transmission line 325 can be connected to the driven element 310 in a variety of ways. In the embodiment shown in FIG. 3, the transmission line 325 is connected to the driven element 310 by a set of linear connectors. However, alternate connections are possible. For example, the connection could be a curved metal layer, a solder connection, etc.

The width of the clearance area 315 is tapered according to the function of the distance to the feed point 320 so as to form a smooth impedance transition, as measured, for example, by a time-domain-reflectometer (TDR). In an exemplary embodiment, a transmission line with characteristic impedance $Z_0$, (e.g., standard 50 ohms), connects to driven element 310 in which case, the clearance width at the feed is made so that its impedance is $2\times Z_0$ (e.g., 100 ohm) to the right side and to the left side. The right side and left side, slots, being in parallel at the feed connection, combine to provide a $Z_0$ impedance (e.g., 50 ohm) load to energy flowing down the transmission line.

As the clearance width increases, the impedance increases. The taper on the clearance width is designed to obtain the desired bandwidth and VSWR parameters. At low frequencies, the antenna 300 becomes an open circuit. In alternative embodiments, a high impedance load is placed across the slot in order to discharge static, if necessary. The bottom center of the antenna 300 constitutes an antenna input 335.

The antenna 300 has two terminals; one terminal is the input 335 to the co-planar transmission line 325, which connects to the driven element 310. The second terminal is the ground element 305. As shown in FIG. 3, in its fundamental EM mode, the antenna 300 generates or receives an electric field (E-field) in the direction of the arrow 340. The antenna 300, thus, has an unbalanced feed, which advantageously negates the need for baluns, which may limit the effective bandwidth of the antenna 300.

Figure 4:
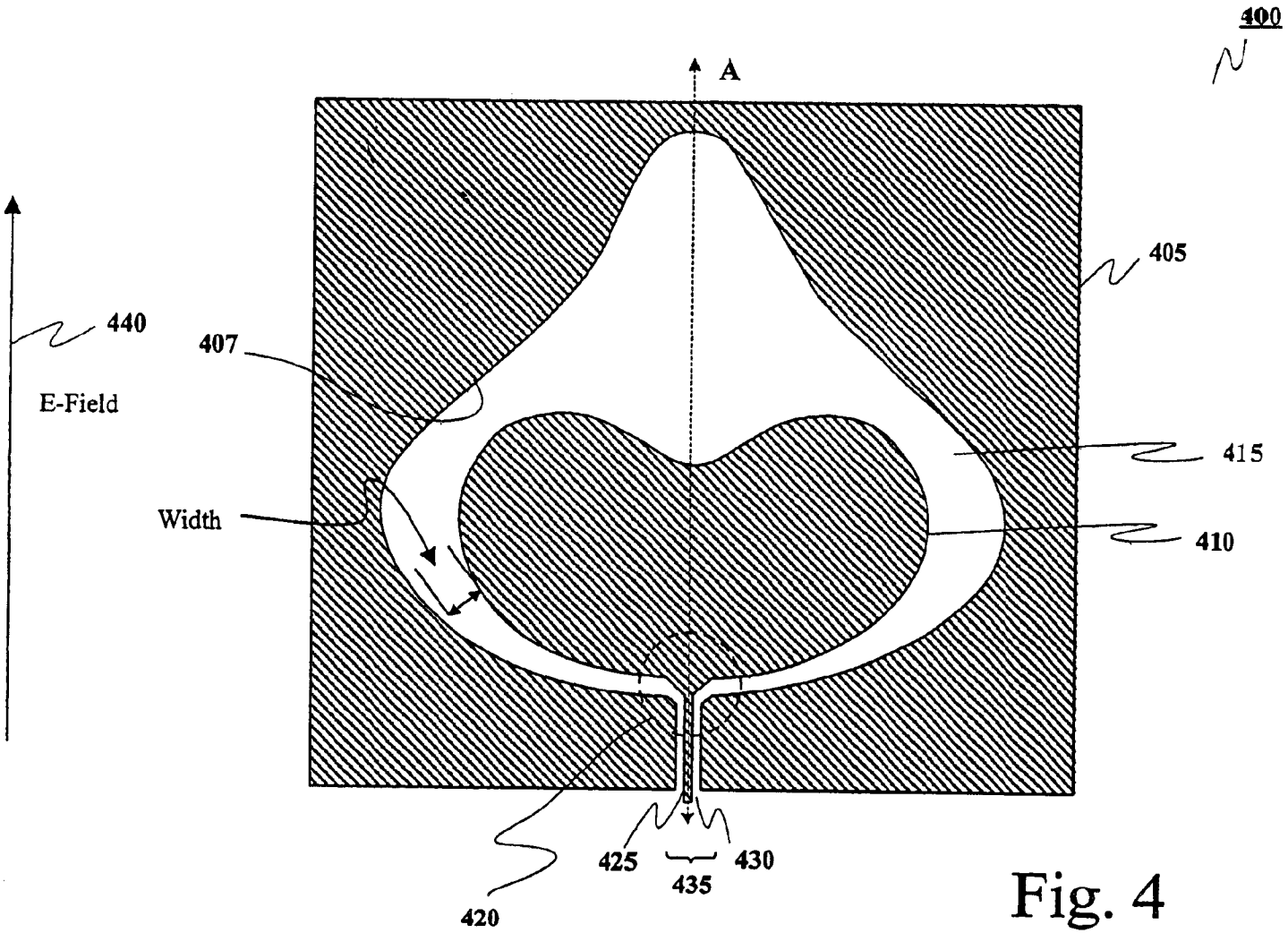
FIG. 4 is a diagram of a UWB antenna having an oval shaped driven portion with a depression in one end, fitted into an oval gap in a ground plane, according to another preferred embodiment of the present invention.

FIG. 4 is a diagram of a UWB antenna according to another alternate embodiment of the present invention. As seen in FIG. 4, the antenna 400 has a ground element (i.e., a ground plane) 405, a driven element 410, a tapered clearance area 415 between the ground element 405 and the driven element 410, a feed point 420, a transmission line 425, and an antenna input 430.

In this embodiment the ground element 405 has an oval or elliptical cutout section with a bulge in one side having an inner circumference 407. The driven element 410 has an oval shape that is smaller in size than the cutout section of the ground element 405, and which also has a depression formed in it on the side nearest the bulge in the cutout section. Both the bulge and the depression are located at positions farthest from the feed point 420. As with the antenna 100 of FIG. 1, the ground element 405 is preferably cut to occupy only a thin perimeter so that the antenna 400 is electrically small.

The driven element 410 and the ground element 405 are preferably formed from any conductive material (e.g., copper). They can be formed on a common plane (or conformal surface) or can be slightly offset, such as the top and bottom of a printed circuit (PC) board.

The driven element 410 is placed inside the cutout section of the ground element 405 to form the tapered clearance area 415. The tapered clearance area 415 is preferably symmetrically tapered about the axis A, which passes through the feed point 420. The tapered clearance area is preferably tapered such that it has a minimum width at the feed point and a maximum width at a point opposite the feed point Both the driven element 410 and the cutout section of the ground element 405 preferably have an axis of symmetry about the feed point 420 (i.e., axis A). The tapered clearance area 415 should be non-conductive.

In alternate embodiments, however, the shape of the cutout section and the driven element 410 can be designed in accordance with the desired application; as a result, the ultimate shape of the tapered clearance area 415 can take many forms, of which a few are discussed herein. In order to maximize bandwidth, the clearance area 415 should be limited such that it does not ever reduce in width as it passes from the feed point 420 to the point opposite the feed point However, in alternate embodiments the taper may not be monotonic in order to create band-rejected regions or otherwise taper the antenna transfer function.

The feed point 420 is preferably located across the narrowest gap between the ground element 405 and the driven element 410. In other words, the feed point 420 is located where the clearance area 415 has a minimum width.

The antenna 400 is driven with the transmission line 425, which is preferably coplanar with and attached to the driven element 410. In the embodiment disclosed in FIG. 4, the transmission line is a metal layer formed on a PC board. However, in alternate embodiments the transmission line could be a magnet wire, a coaxial cable, a line laid over the ground plane, a twin-lead line, a twisted pair line, or any other desired transmission medium.

As noted above, in the embodiment shown in FIG. 4 the transmission line 425 is coplanar with both the driven element 410 and the ground element 405. As a result a gap 430 is formed in the ground element 405 to allow the transmission line 425 to pass. In alternate embodiments, where the transmission line 425 and the ground element 405 are not co-planar, no such gap 430 in the ground element 405 is required.

The transmission line 425 can be connected to the driven element 410 in a variety of ways. In the embodiment shown in FIG. 4, the transmission line 425 is connected to the driven element 410 by a set of linear connectors. However, alternate connections are possible. For example, the connection could be a curved metal layer, a solder connection, etc.

The width of the clearance area 415 is tapered according to the function of the distance to the feed point 420 so as to form a smooth impedance transition, as measured, for example, by a time-domain-reflectometer (TDR). In an exemplary embodiment, a transmission line with characteristic impedance $Z_0$, (e.g., standard 50 ohms), connects to driven element 410 in which case, the clearance width at the feed is made so that its impedance is $2\times Z_0$ (e.g., 100 ohm) to the right side and to the left side. The right side and left side slots, being in parallel at the feed connection, combine to provide a $Z_0$ impedance (e.g., 50 ohm) load to energy flowing down the transmission line.

As the clearance width increases, the impedance increases. The taper on the clearance width is designed to obtain the desired bandwidth and VSWR parameters. At low frequencies, the antenna 400 becomes an open circuit. In alternative embodiments, a high impedance load is placed across the slot in order to discharge static, if necessary. The bottom center of the antenna 400 constitutes an antenna input 435.

The antenna 400 has two terminals: one terminal is the input 435 to the co-planar transmission line 425, which connects to the driven element 410. The second terminal is the ground element 405. As shown in FIG. 4, the antenna 400 generates or receives an electric field (E-field) in the direction of the arrow 440. The antenna 400 thus has an unbalanced feed, which advantageously negates the need for baluns, which may limit the effective bandwidth of the antenna 400.

Figure 5:
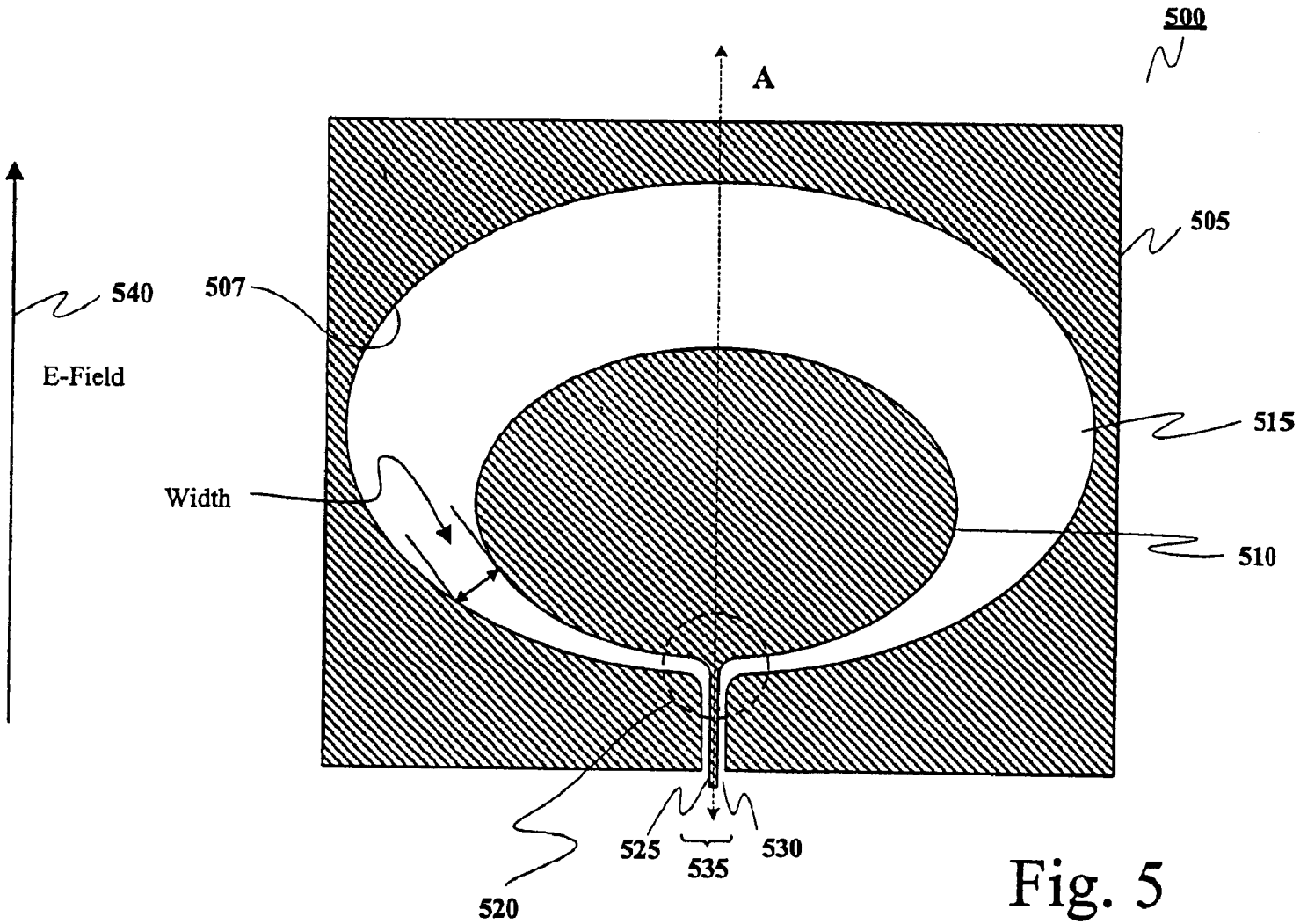
FIG. 5 is a diagram of a UWB antenna having an oval shaped driven portion, fitted into an oval gap in a ground plane, with a concave on connecting the driven portion to a transmission line, according to another preferred embodiment of the present invention.

FIG. 5 is a diagram of a UWB antenna according to yet another alternate embodiment of the present invention. As seen in FIG. 5, the antenna 500 has a ground element (i.e., a ground plane) 505 having an inner circumference 507, a driven element 510, a tapered clearance area 515 between the ground element 505 and the driven element 510, a feed point 520, a transmission line 525, and an antenna input 530.

This embodiment is similar to that shown in FIG. 1, except that where the transmission line 525 connects to the driven element 510 the meeting is characterized by two linear concave portions that face the clearance area 515. Similarity, the portion of the ground element 505 that is removed to allow passage of the transmission line 525 has two linear convex portions that face the clearance area 515. This smoother transition can improve the voltage standing wave ration (VSWR) as will be more apparent in FIG. 7. In alternate embodiments where the ground element 505 and the transmission line 525 are not co-planar, such convex portions are not required.

Figure 6:
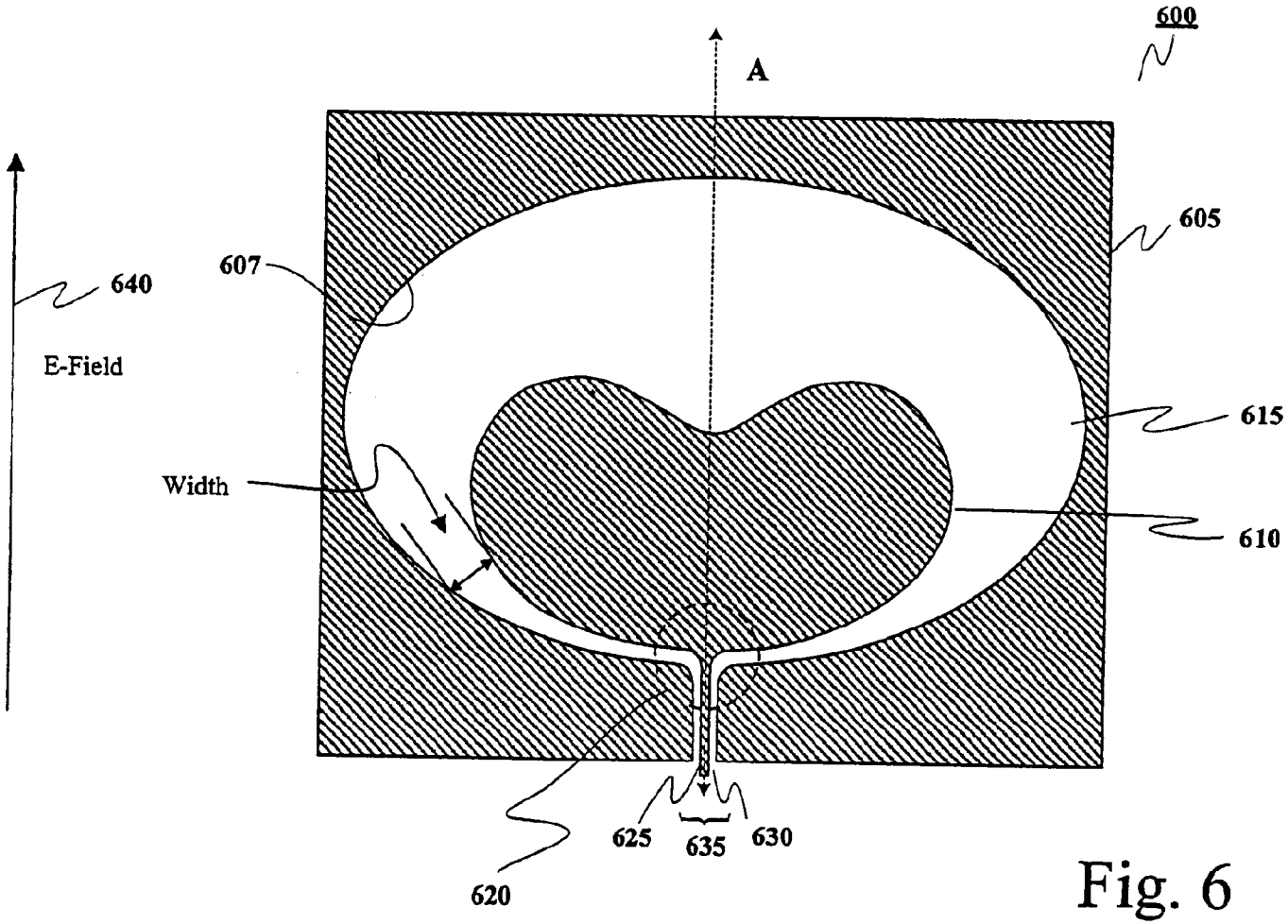
FIG. 6 is a diagram of a UWB antenna having an oval shaped driven portion with a depression in one end, fitted into an oval gap in a ground plane, with a concave portion connecting the driven portion to a transmission line, according to another preferred embodiment of the present invention.

FIG. 6 is a diagram of a UWB antenna according to still another alternate embodiment of the present invention. As seen in FIG. 6, the antenna 600 has a ground element (i.e., a ground plane) 605 having an inner circumference 607, a driven element 610, a tapered clearance area 615 between the ground element 605 and the driven element 610, a feed point 620, a transmission line 625, and an antenna input 630.

This embodiment is similar to that shown in FIG. 3, except that where the transmission line 625,connects to the driven element 610 the meeting is characterized by two linear concave portions that face the clearance area 615. Similarly, the portion of the ground element 605 that is removed to allow passage of the transmission line 625. has two linear convex portions that face the clearance area 615. This smoother transition can improve the voltage standing wave ration (VSWR) as will be more apparent in FIG. 8. In alternate embodiments where the ground element 605 and the transmission line 625 are not co-planar, such convex portions are not required.

Figure 7:
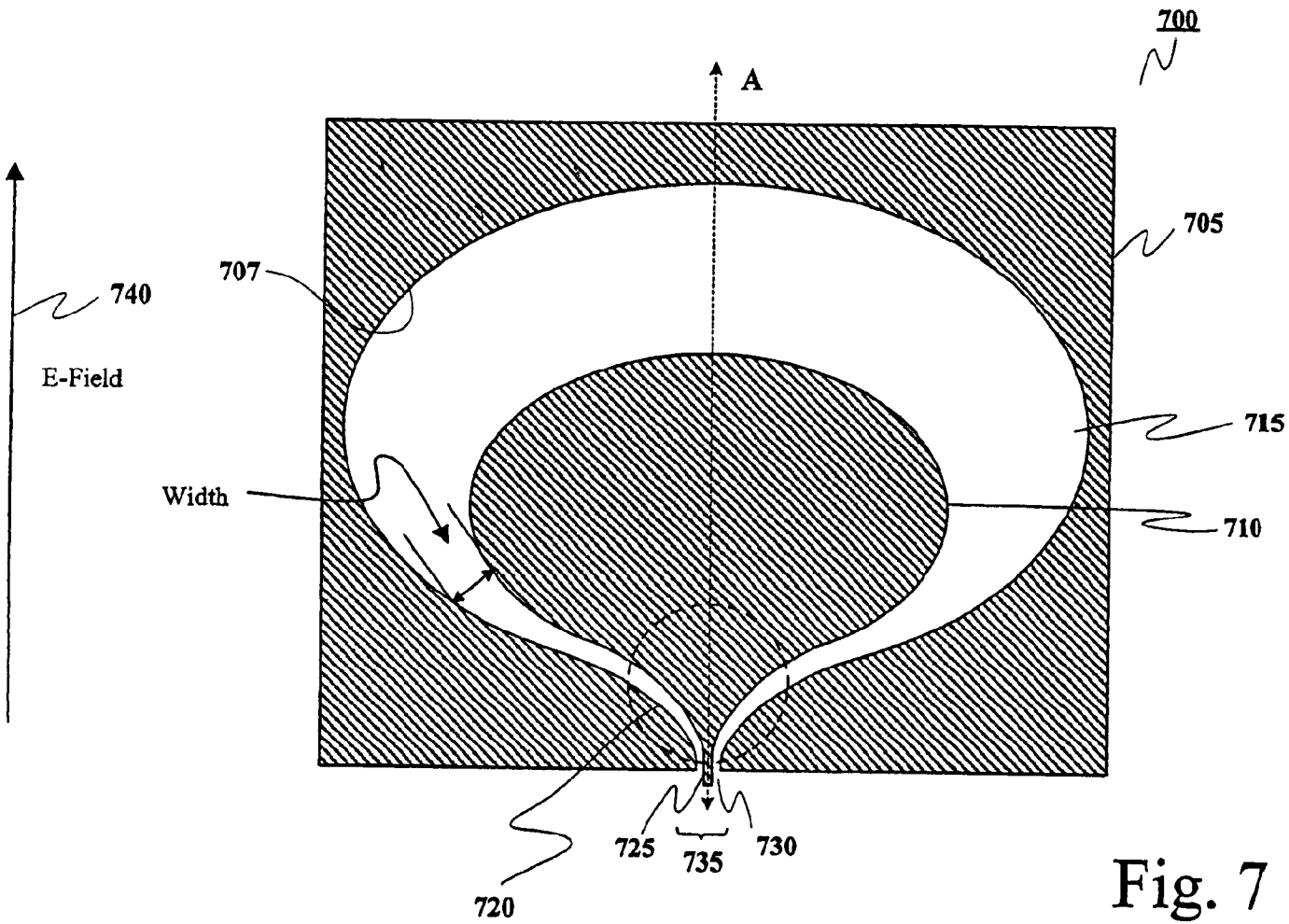
FIG. 7 is a diagram of a UWB antenna having an oval shaped driven portion, fitted into an oval gap in a ground plane, with a concave portion connecting the driven portion to a transmission line, according to an alternate preferred embodiment of the present invention.

FIG. 7 is a diagram of a UWB antenna according to yet another alternate embodiment of the present invention. As seen in FIG. 7, the antenna 700 has a ground element (i.e., a ground plane) 705 having an inner circumference 707, a driven element 710, a tapered clearance area 715 between the ground element 705 and the driven element 710, a feed point 720, a transmission line 725, and an antenna input 730.

This embodiment is similar to that shown in FIG. 5, except that the two linear concave portions where the transmission line 725 connects to the driven element 710 are more pronounced. Similarly, the two linear convex portions of the ground element 705 are likewise more pronounced. The long taper of the concave portions provides a better VSWR at higher frequencies. As with the embodiment of FIG. 5, in alternate embodiments where the ground element 705 and the transmission line 725 are not co-planar, such convex portions are not required.

Figure 8:
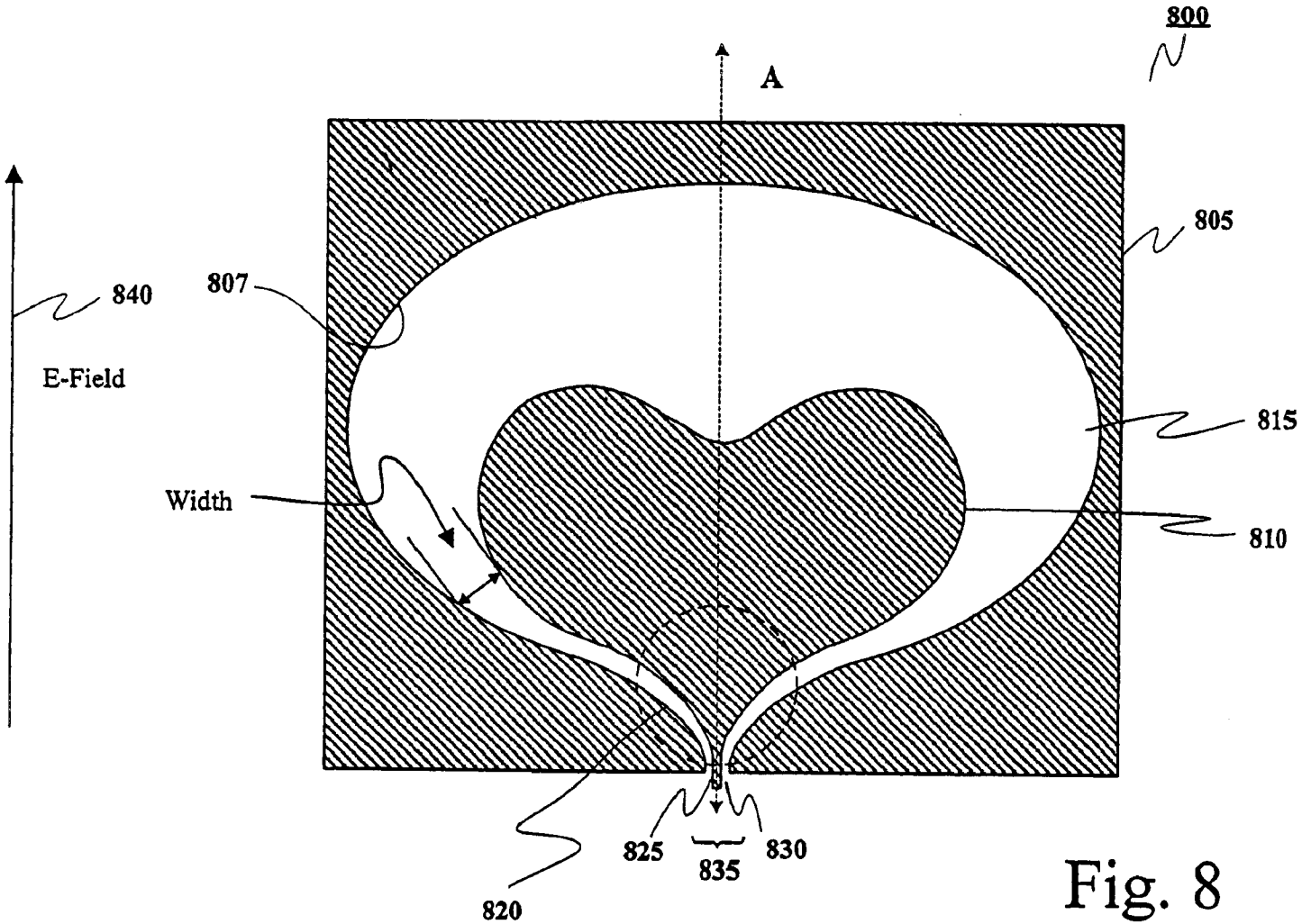
FIG. 8 is a diagram of a UWB antenna having an oval shaped driven portion with a depression in one end, fitted into an oval gap in a ground plane, with a concave portion connecting the driven portion to a transmission line, according to an alternate preferred embodiment of the present invention.

FIG. 8 is a diagram of a UWB antenna according to yet another alternate embodiment of the present invention. As seen in FIG. 8, the antenna 800 has a ground element (i.e., a ground plane) 805 having an inner circumference 807, a driven element 810, a tapered clearance area 815 between the ground element 805 and the driven element 810, a feed point 820, a transmission line 825, and an antenna input 830.

This embodiment is similar to that shown in FIG. 6, except that the two linear concave portions where the transmission line 825 connects to the driven element 810 are more pronounced. The long taper of the concave portions provides for a better impedance match at higher frequencies. Similarly, the two linear convex portions of the ground element 805 are likewise more pronounced. As with the embodiment of FIG. 6, in alternate embodiments where the ground element 805 and the transmission line 825 are not co-planar, such convex portions are not required.

Figure 9:
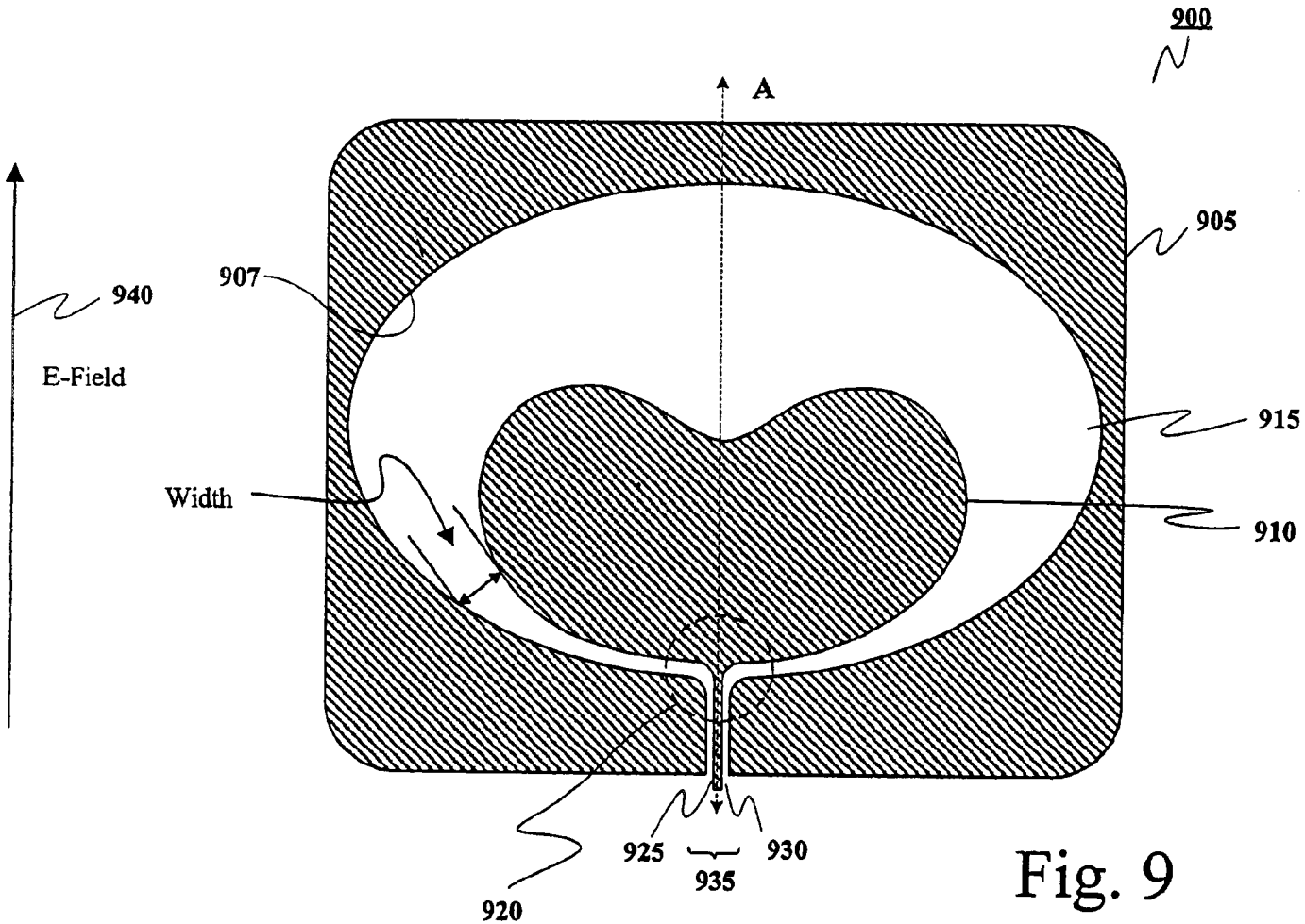
FIG. 9 is a diagram of a UWB antenna having curved comers in a ground plane, according to a preferred embodiment of the present invention.

FIG. 9 is a diagram of a UWB antenna according to yet another alternate embodiment of the present invention. As seen in FIG. 9, the antenna 900 has a ground element (i.e., a ground plane) 905 having an inner circumference 907, a driven element 910, a tapered clearance area 915 between the ground element 905 and the driven element 910, a feed point 920, a transmission line 925, and an antenna input 930.

This embodiment is similar to that shown in FIG. 6, except that the outside edge of the ground element 905 is formed with convex portions instead of comers at the outside edge. This can reduce the size of the antenna 900 and the amount of material required to form the ground element 905. It also slightly tunes the frequency response of the antenna. The degree of convexity chosen may vary as needed, and need not be identical on each comer. However, preferably the top two comers are similar and the bottom two comers are similar.

Figure 10:
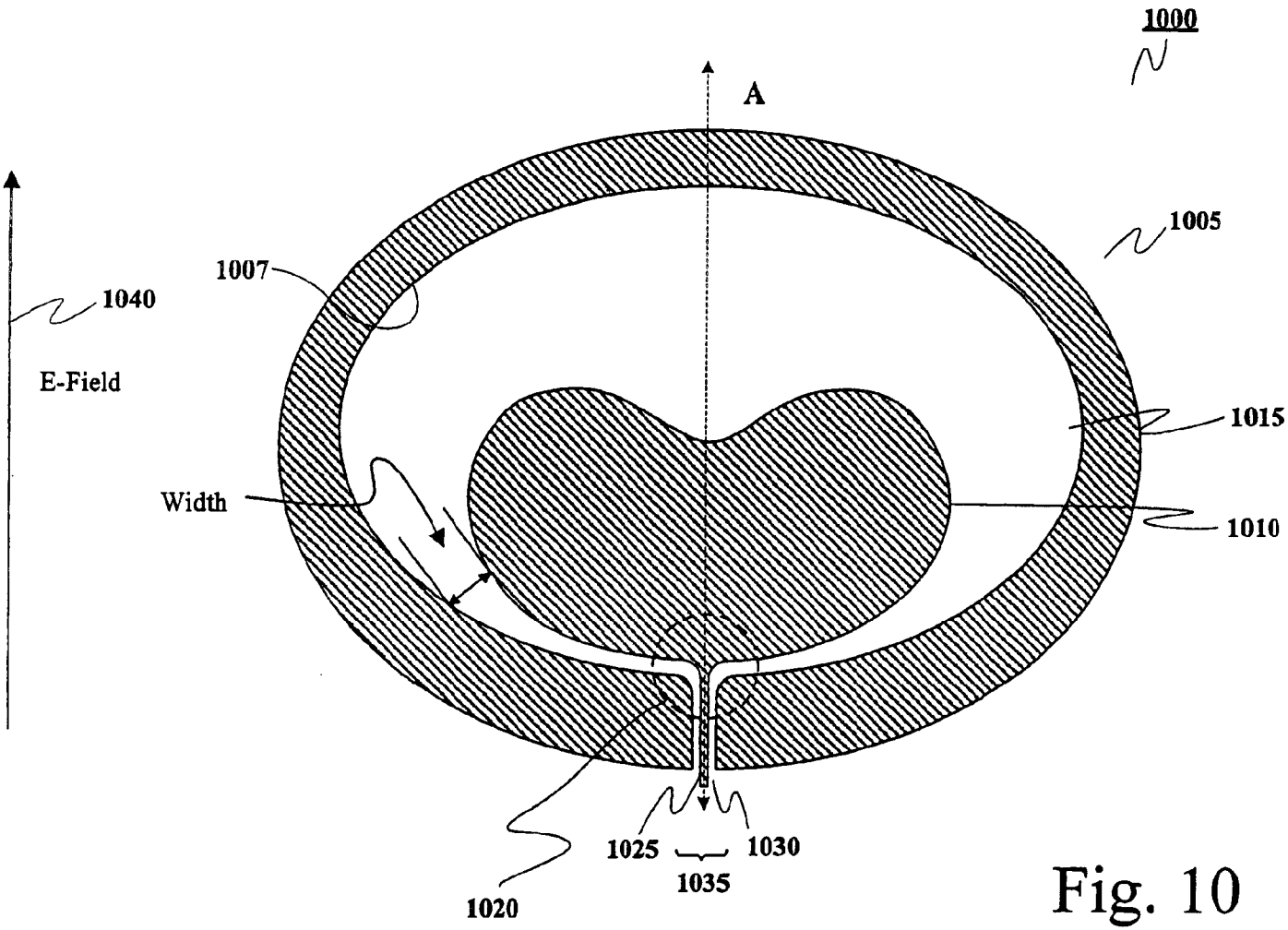
FIG. 10 is a diagram of a UWB antenna having a curved ground plane, according to a preferred embodiment of the present invention.

FIG. 10 is a diagram of a UWB antenna according to yet another alternate embodiment of the present invention. As seen in FIG. 10, the antenna 1000 has a ground element (i.e., a ground plane) 1005 having an inner circumference 1007, a driven element 1010, a tapered clearance area 1015 between the ground element 1005 and the driven element 1010, a feed point 1020, a transmission line 1025, and an antenna input 1030.

This embodiment is similar to that shown in FIG. 6, except that the ground element 1005 is formed to me a narrow band around the cutout portion. This can reduce the size of the antenna 1000 and the amount of material required to form the ground element 1005. The width of the ground element 1005 may vary as needed, and need not be identical throughout the circumference of the ground element 1005.

Typically it is best to maintain left-right symmetry for a symmetric beam pattern. However, some applications do not require symmetrical beam patterns, and so for these alternate embodiments so left-right symmetry is required. Also, the width of the ground element can be used to adjust the antenna's transfer function.

Figure 11:
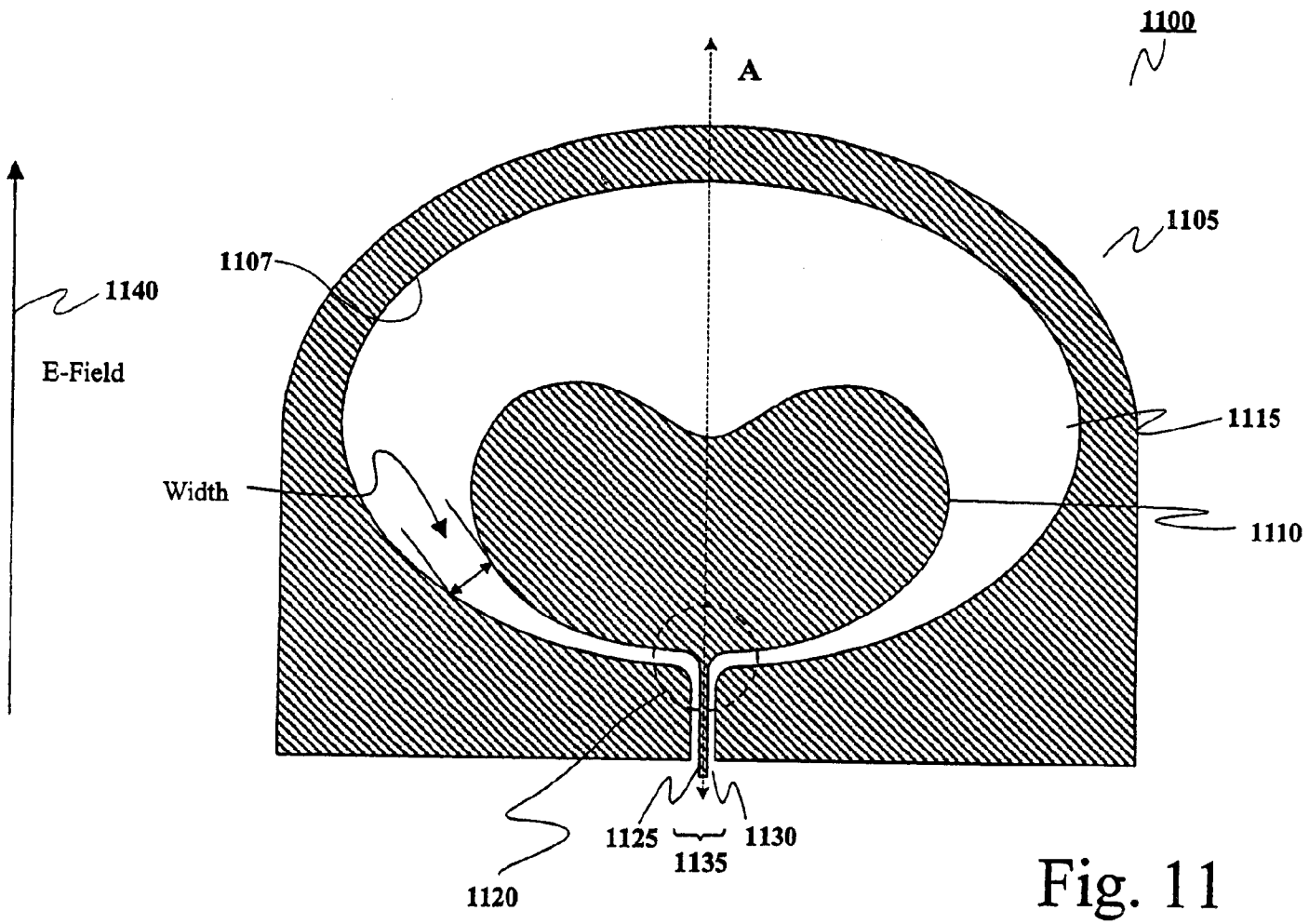
FIG. 11 is a diagram of a UWB antenna having a partially curved ground plane, according to a preferred embodiment of the present invention.

FIG. 11 is a diagram of a UWB antenna according to yet another alternate embodiment of the present invention. As seen in FIG. 11, the antenna 1100 has a ground element (i.e., a ground plane) 1105 having an inner circumference 1107, a driven element 1110, a tapered clearance area 1115 between the ground element 1105 and the driven element 1110, a feed point 1120, a transmission line 1125, and an antenna input 1130.

This embodiment is similar to that shown in FIGS. 6 and 10, except that the ground element 1105 is formed to be partly rectangular and partly band-shaped. In this particular embodiment the portion of the ground element 1105 closer to the feed point 1120 is rectangular-shaped, while the portion of the ground element 1105 farthest from the fed point 1120 is band-shaped. This can reduce the size of the antenna 1100 and the amount of material required to form the ground element 1105, and can be used to fit the antenna 1100 into a particular sized or shaped area.

As above, it is typically it is best to maintain left-right symmetry for a symmetric beam pattern. However, as noted, some applications do not require symmetrical beam patterns, and so for these alternate embodiments so left-right symmetry is required. The width of the ground element in this embodiment can also be used to adjust the antenna's transfer function.

As the embodiments of FIGS. 3–11 show, the size and shape of the ground element can be varied as needed. It should not be limited in size and shape, but may be altered to meet various design requirements. For example a combination of narrow bands, comers, and rounded comers could be used in a single antenna design. In each embodiment, however, the ground element preferably substantially surrounds the driven element. However, in some alternate embodiments a gap may be formed in the ground element on the side of the driven element opposite the feed point FIGS. 12A to 20B show various embodiments that illustrate alternate ways that. the transmission line (125 in FIG. 1) can be connected to the ground element (105 in. FIG. 1).

These embodiments are being disclosed by way of example, however, and not. by way of limitation. It is understood that various modifications and combinations of the disclosed embodiments are possible and are considered to be within the scope of the present invention.

Figures 12A, 12B:
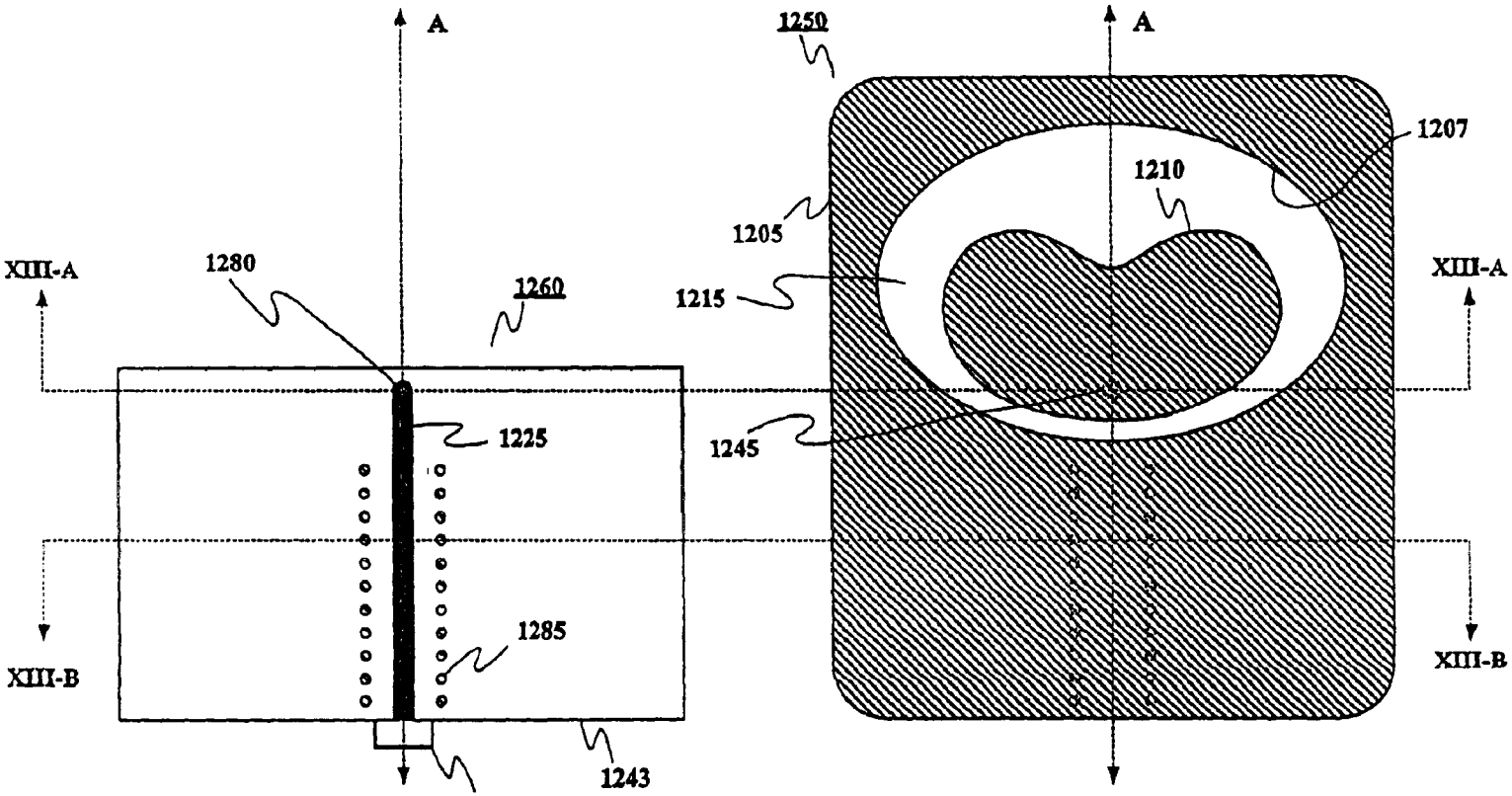
FIGS. 12A and 12B are plan views of an antenna according to a preferred embodiment of the present invention.
Figure 13A:
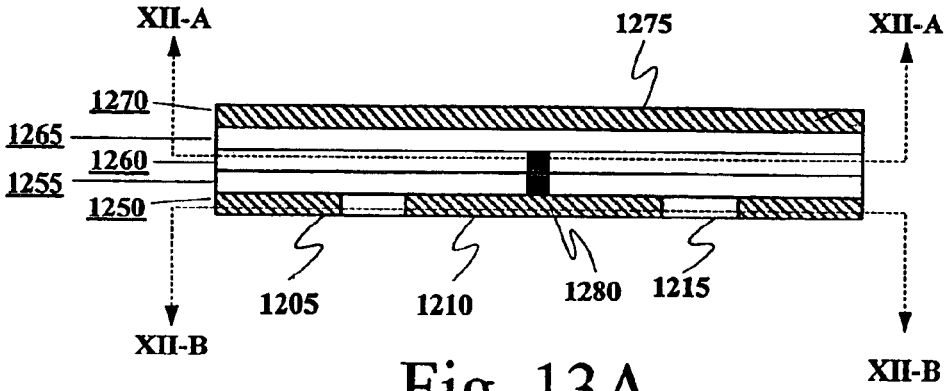
FIGS. 13A and 13B are cutaway views of the antennas shown in FIGS. 12A and 12B.
Figure 13B:
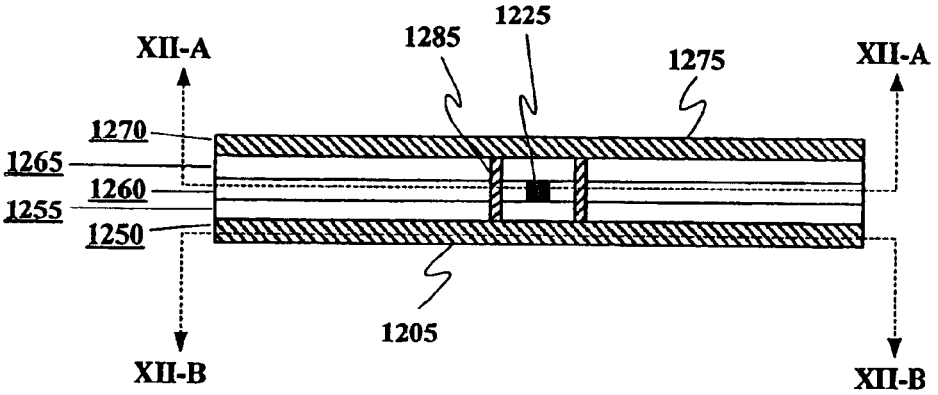

FIGS. 12A and 12B are overhead views of the layers of an antenna according to a preferred embodiment of the present invention using a metal layer as a transmission line that connects the antenna to a remote circuit via a connection interface. FIGS. 13A and 13B are cutaway views of the antenna of FIGS. 12A and 12B. FIG. 12A corresponds to the cutaway arrows XII-A in FIGS. 13A and 13B; FIG. 12B corresponds to the cutaway arrows XII-B in FIGS. 13A and 13B; FIG. 13A corresponds to the cutaway arrows XIII-A in FIGS. 12A and 12B; and FIG. 13B corresponds to the cutaway arrows XIII-B in FIGS. 12A and 12B.

As shown in FIGS. 12A to 13B, the antenna of this embodiment includes five separate layers: first through third circuit layers 1250, 1260, and 1270, and first and second insulating layers 1255 and 1265. The first circuit layer 1250 includes a ground element 1205, a driven element 1210, and a tapered clearance area 1215; the second circuit layer 1260 includes a transmission line 1235 and an insulating portion 1243; the third circuit layer 1270 includes a ground plane 1275; and the first insulating layer 1255 includes a transmission via 1280. In addition, a plurality of shielding vias 1285 are formed through the first and second insulating layers 1255 and 1265 and the insulating portion 1243 of the second circuit layer 1260. The transmission line 1235 passes over a portion of the ground element 1205 and connects to a transmission interface 1290 that in turn connects to an external circuit (not shown).

In the first circuit layer 1250 the ground element 1205 is formed with a cutout section having an inner circumference 1207 that is a simple dosed curve. The driven element 1210 is also a simple closed curve and has a circumference that is less than the inner circumference 1207 of the ground element 1205. The driven element 1210 is formed inside of the cutout section to define a tapered clearance area 1215 between the ground element 1205 and the driven element 1210.

This clearance area 1215 is preferably formed such that it is symmetrical around an axis of symmetry A, having a narrow portion at one end and a wide portion at the other end. Preferably the clearance area 1215 is tapered such that a clearance width between the driven element and the ground element is monotonically nondecreasing as it passes from the narrow portion to the wide portion.

At one end the transmission line 1235 connects to the driven element 1210 through the transmission via 1280 at a connection point 1245 proximate to the narrow portion of the clearance area 1215 (i.e., the feed point). At the other end the transmission line 1235 connects to the transmission interface 1290. The insulating portion 1243 surrounds the transmission line 1243 to protect it from unwanted connections.

The plurality of shielding vias 1285 are preferably formed to surround the transmission line 1235 and connect the ground element 1205 to the ground plane 1275. In this way the ground element 1205, the ground plane 1275, and the shielding vias 1280 serve to shield the transmission line 1235 and prevent it from interfering with other elements in the antenna.

The ground element 1205, the driven element 1210, and the transmission line. are preferably formed from a conductive material, e.g., copper. The transmission via 1280 and the plurality of shielding vias 1285 are preferably filled with a conductive material, which may be the same as the material that forms the ground element 1205 and the driven element 1210.

The first and second insulating layers 1255 and 1265 are preferably formed out of a non-conductive material such as FR-4, Teflon, fiberglass, air, or any other suitable insulating material. The area in the second circuit layer 1260 surrounding the transmission line 1235 and the shielding vias 1280 is also preferably formed from a non-conductive conductive material such as FR-4, Teflon, fiberglass, air, or any other suitable insulating material. The area of the second circuit layer 1260 filled with non-conductive material may be the same as the area of the first and second insulating layers 1255 and 1265, or may be smaller.

The tapered clearance area 1215 is also preferably non-conductive, and can be formed out of FR-4, Teflon, fiberglass, or some other suitable insulating material, or can simply be open air.

Although the first circuit layer 1250 is shown as forming the bottom layer and the third circuit layer 1270 is shown as forming the top layer, the particular orientation of these layers is not important. Variations on the orientation of the layers are possible, with either one being on top or bottom.

Figures 14A, 14B:
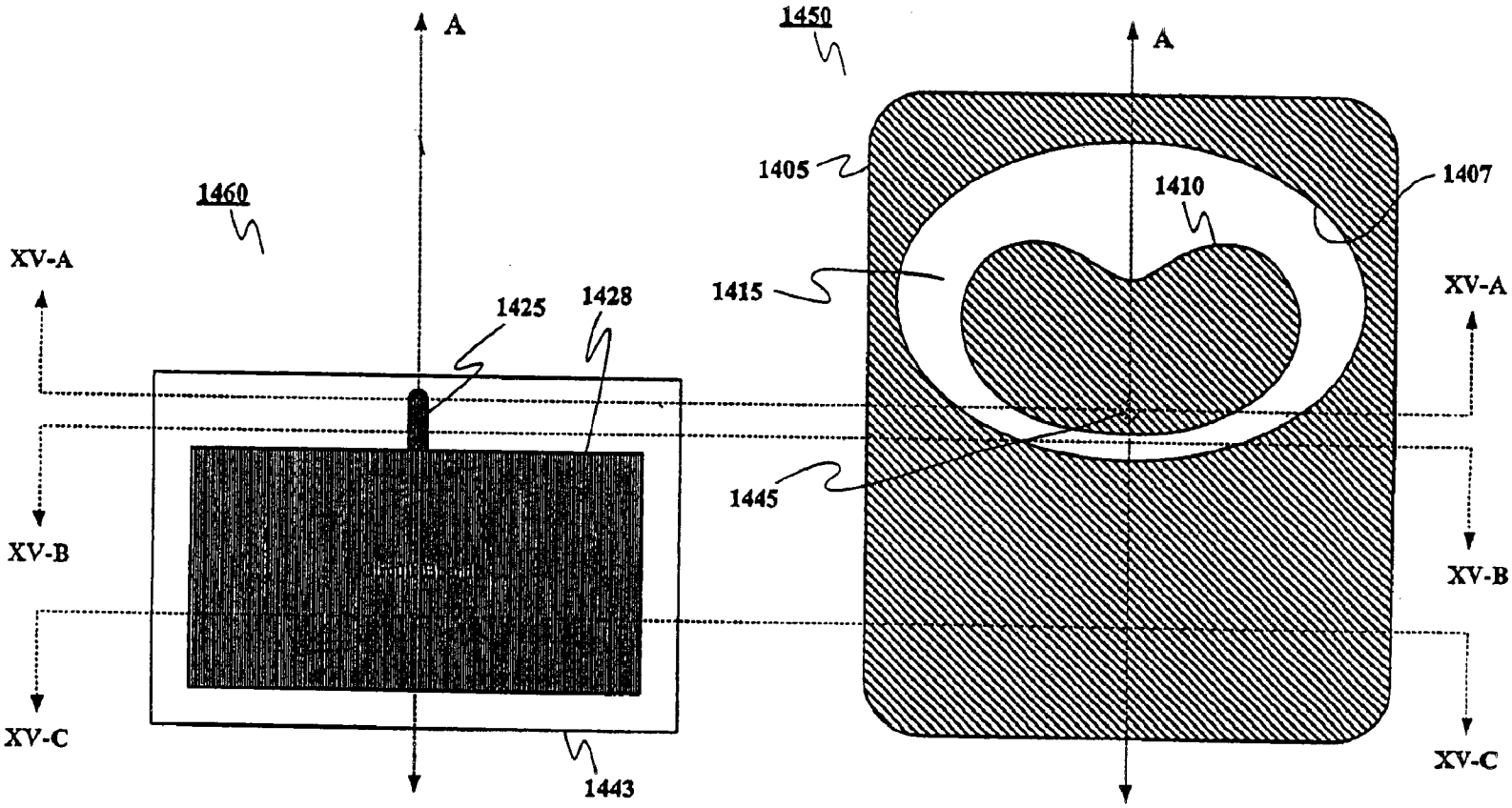
FIGS. 14A and 14B are plan views of an antenna according to an alternate preferred embodiment of the present invention.
Figure 15A:
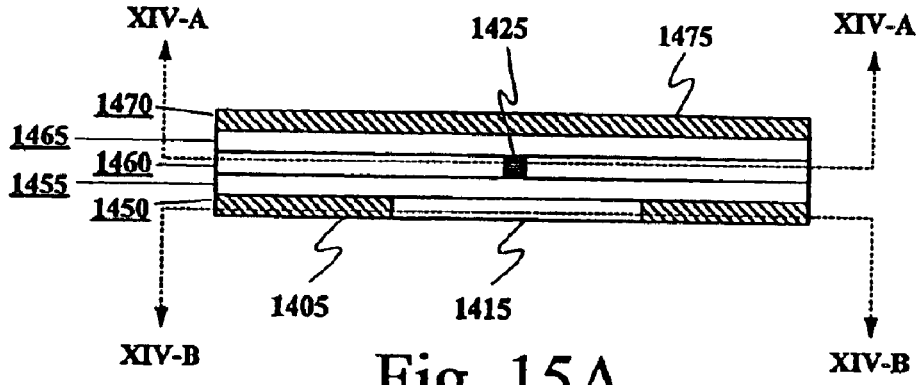
FIGS. 15A–15C are cutaway views of the antennas shown in FIGS. 14A and 14B.
Figure 15B:
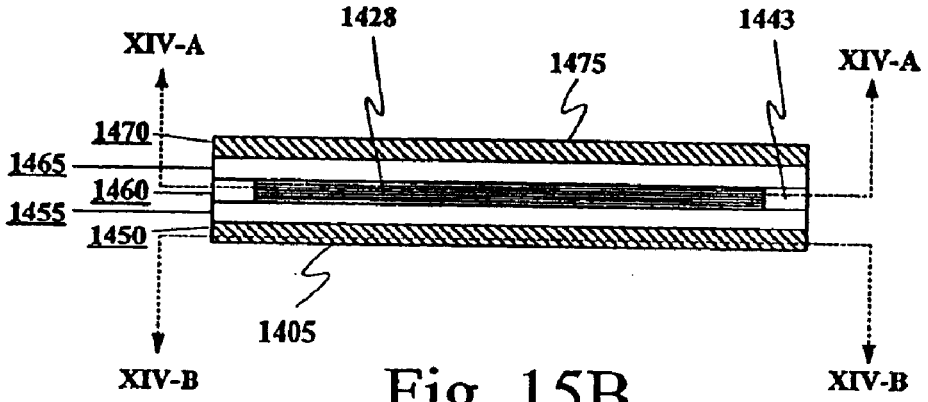
Figure 15C:
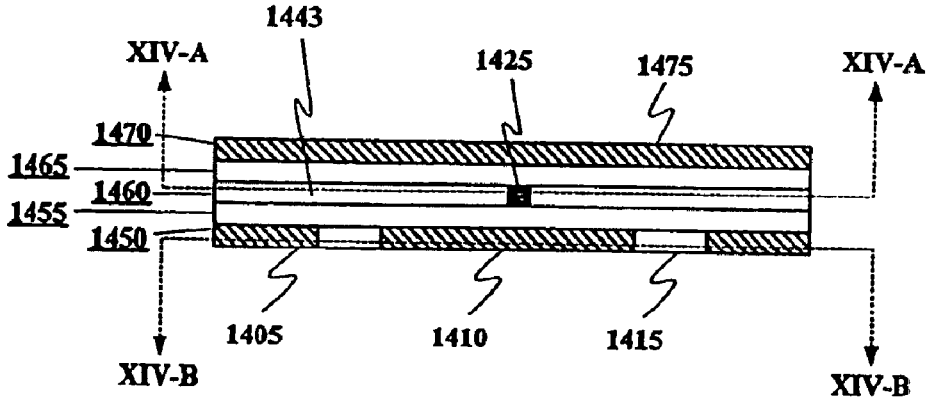

FIGS. 14A and 14B are overhead views of the layers of an antenna according to a preferred embodiment of the present invention using a metal layer as a transmission line to connect the antenna to a circuit attached directly to the antenna. FIGS. 15A to 15C are cutaway views of the antenna of FIGS. 14A and 14B. FIG. 14A corresponds to the cutaway arrows XIV-A in FIGS. 15A to 15C; FIG. 14B corresponds to the cutaway arrows XIV-B in FIGS. 15A to 15C; FIG. 14B corresponds to the cutaway arrows XIV-B in FIGS. 15A to 15C; FIG. 15A corresponds to the cutaway arrows XV-A in FIGS. 14A and 14B; FIG. 15B corresponds to the cutaway arrows XV-B in FIGS. 14A and 14B; and FIG. 15C corresponds to the cutaway arrows XV-C in FIGS. 14A and 14B.

As shown in FIGS. 14A to 15C, the antenna of this embodiment includes five separate layers: first through third circuit layers 1450, 1460, and 1470, and first and second insulating layers 1455 and 1465. The first circuit layer 1450 includes a ground element 1405, a driven element 1410, and a tapered clearance area 1415; the second circuit layer 1460 includes a transmission line 1425, a circuit board 1428 and an insulating portion 1443; the third circuit layer 1470 includes a ground plane 1475; and the first insulating layer 1455 includes a transmission via 1480. The circuit board 1428 is preferably formed over a portion of the ground element 1405.

In the first circuit layer 1450 the ground element 1405 is formed with a cutout section having an inner circumference 1407 that is a simple dosed curve. The driven element 1410 is also a simple closed curve and has a circumference that is less than the inner circumference 1407 of the ground element 1405. The driven element 1410 is formed inside of the cutout section to define a tapered clearance area 1415 between the ground element 1405 and the driven element 1410.

This clearance area 1415 is preferably formed such that it is symmetrical around an axis of symmetry A, having a narrow portion at one end and a wide portion at the other end. Preferably the clearance area 1415 is tapered such that a clearance width between the driven element and the ground element is monotonically nondecreasing as it passes from the narrow portion to the wide portion.

At one end the transmission line 1425 connects to the driven element 1410 through the transmission via 1480 at a connection point 1445 proximate to the narrow portion of the clearance area 1415 (i.e., the feed point). At the other end the transmission line 1425 connects to the circuit board 1428. The insulating portion 1443 surrounds the transmission line 1443 to protect it from unwanted connections.

The circuit board 1428 can include traces to connect electronic parts together to make, for example, a transmitter or receiver. This allows low cost integration radio systems. Circuitry on the circuit board is preferably designed to make the antenna shown in FIGS. 14A to 15C operate as desired. Although not shown, the circuit board 1428 may have external connections for a power supply and to receive and send information to another device it is connected to. The circuit board 1428 may have an insulating portion surrounding it to protect it from harm or such an insulating portion may be omitted.

The ground element 1405, the driven element 1410, and the transmission line are preferably formed from a conductive material, e.g., copper. The transmission via 1480 and the plurality of shielding vias 1485 are preferably filled with a conductive material.

The first and second insulating layer 1455 and 1465 are preferably formed out of a non-conductive material such as FR-4, Teflon, fiberglass, air, or any other suitable insulating material. The area in the second circuit layer 1460 surrounding the transmission line 1425 and the shielding vias 1480 is also preferably formed from a non-conductive material such as FR-4, Teflon, fiberglass, air, or any other suitable insulating material. The area of the second circuit layer 1460 filled with non-conductive material may be the same as the area of the first and second insulating layers 1455 and 1465, or may be smaller.

The tapered clearance area 1415 is also preferably non-conductive, but can be formed out of FR-4, Teflon, fiberglass, or any other suitable insulating material, or can simply be open air.

Although the first circuit layer 1450 is shown as forming the bottom layer and the third circuit layer 1470 is shown as forming the top layer, the particular orientation of these layers is not important. Variations on the orientation of the layers are possible, with either one being on top or bottom.

Figure 16B:
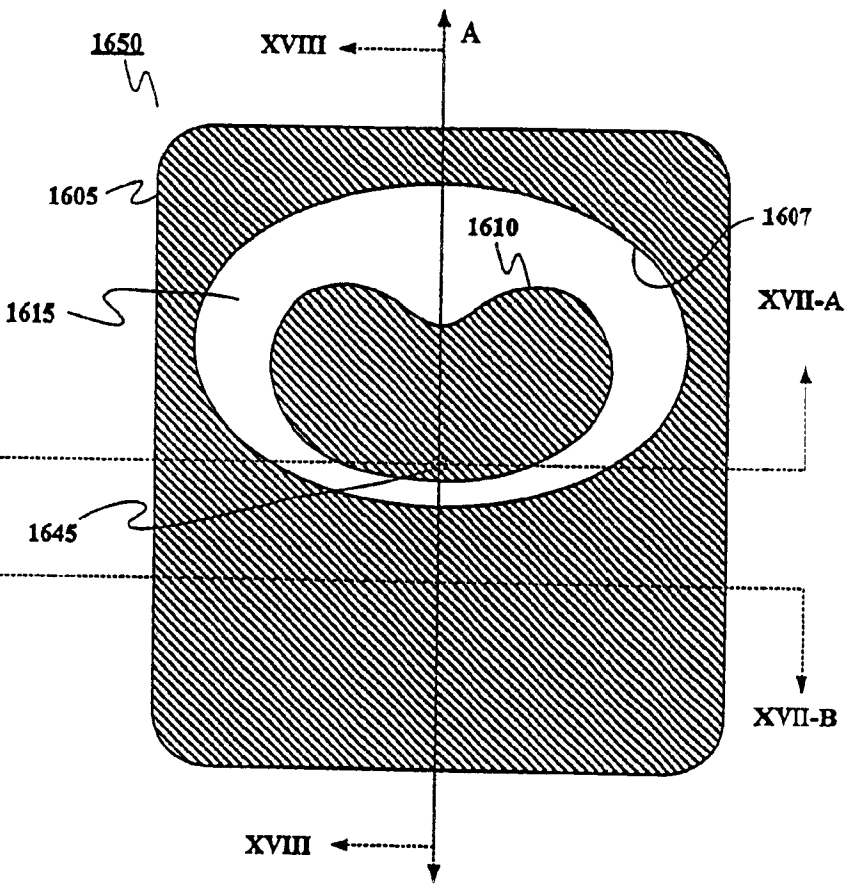
FIGS. 16A and 16B are plan views of an antenna according to another preferred embodiment of the present invention.
Figure 16A:
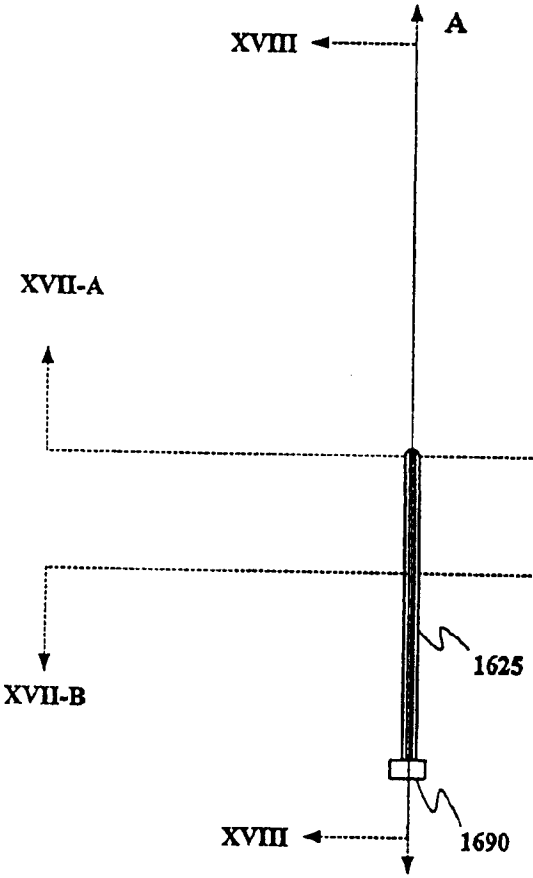
Figure 17A:
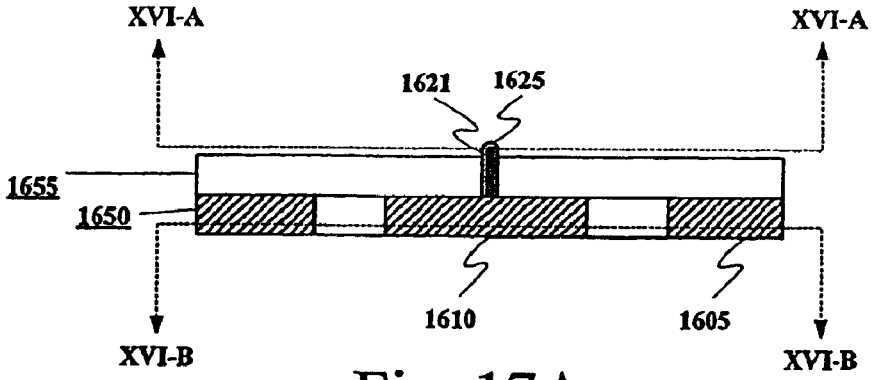
FIGS. 17A, 17B, and 18 are cutaway views of the antennas shown in FIGS. 16A and 16B.
Figure 17B:
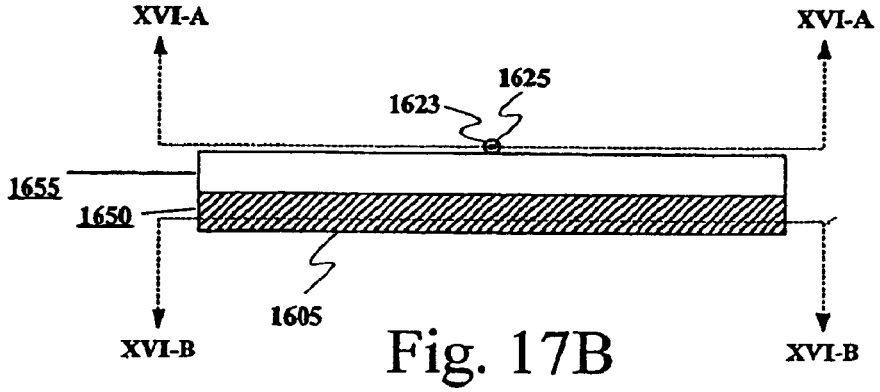
Figure 18:
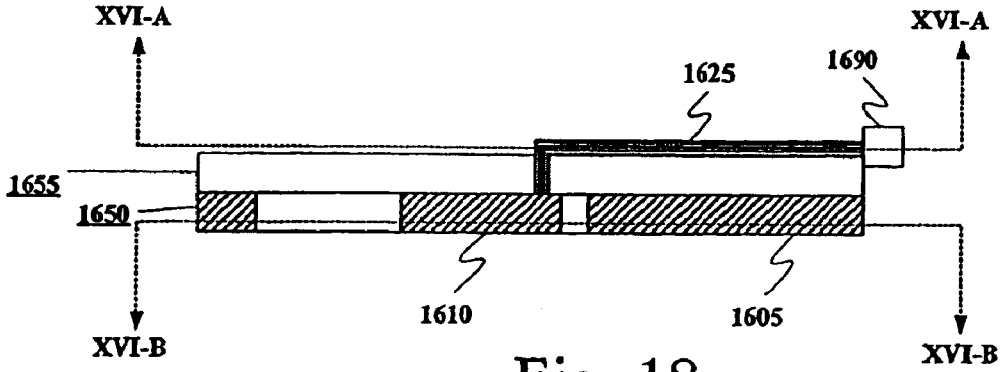

FIGS. 16A and 16B are overhead views of the layers of an antenna according to a preferred embodiment of the present invention using a magnet wire as a transmission line that connects the antenna to a remote circuit via a connection interface. FIGS. 17A, 17B, and 18 are cutaway views of the antenna of FIGS. 16A and 16B. FIG. 16A corresponds to the cutaway arrows XVI-A in FIGS. 17A to 18; FIG. 16B corresponds to the cutaway arrows XVI-B in FIGS. 17A to 18; FIG. 17A corresponds to the cutaway arrows XVII-A in FIGS. 16A and 16B; FIG. 17B corresponds to the cutaway arrows XVII-B in FIGS. 16A and 16B; and FIG. 18 corresponds to the cutaway arrows XVIII-C in FIGS. 16A and 16B.

As shown in FIGS. 16A to 18, the antenna of this embodiment includes two separate layers: a circuit layer 1650 and an insulating layer 1655. A transmission line 1625 passes over a portion of the insulating layer 1655.

The circuit layer 1650 includes a ground element 1605, a driven element 1610, and a tapered clearance area 1615; and the first insulating layer 1655 includes a transmission via 1680. The transmission line 1625 is preferably a magnet wire or other similar wire. The magnet wire includes a metal core 1621 surrounded by an insulating material 1623, and such wires are well known in the art. The transmission line 1625 passes over a portion of the ground element 1605 and connects to a transmission interface 1690 that connects to an external circuit (not shown).

In the first circuit layer 1650 the ground element 1605 is formed with a cutout section having an inner circumference 1607 that is a simple closed curve. The driven element 1610 is also a simple closed curve and has a circumference that is less than the inner circumference 1607 of the ground element 1605. The driven element 1610 is formed inside of the cutout section to define a tapered clearance area 1615 between the ground element 1605 and the driven element 1610.

This clearance area 1615 is preferably formed such that it is symmetrical around an axis of symmetry A, having a narrow portion at one end and a wide portion at the other end. Preferably the clearance area 1615 is tapered such that a clearance width between the driven element and the ground element is monotonically nondecreasing as it passes from the narrow portion to the wide portion.

At one end the transmission line 1625 connects to the driven element 1610 through the transmission via 1680 at a connection point 1645 proximate to the narrow portion of the clearance area 1615. At the other end the transmission line 1625 connects to the transmission interface 1690.

Although this embodiment shows the transmission via 1680 being filled with the magnet wire that forms the transmission line, alternate embodiments may provide alternate connections. For example, the transmission via could be filled with a conductive material as in the embodiment of FIGS. 11A and 11B. In this case the conductive material in the transmission via would connect to the driven element 1610 at the connection point 1645 and the transmission line 1625 (i.e., the magnet wire) would connect to the conductive material in the transmission via 1680.

The ground element 1605, the driven element 1610, and the transmission line are preferably formed from a conductive material, e.g., copper. The transmission via 1680 and the plurality of shielding vias 1685 are preferably filled with a conductive material.

The insulating layer 1655 is preferably formed out of a nonconductive material such as FR-4, Teflon, fiberglass, air, or any other suitable insulating material. The tapered clearance area 1615 is also preferably non-conductive, but can be formed out of, FR-4, Teflon, fiberglass, or any other suitable insulating material, or can simply be open air.

Although the insulating layer 1655 is shown as forming the top layer and the circuit layer 1650 is shown as forming the lower layer, the particular orientation of these layers is not important. Variations on the orientation of the layers are possible, with either one being on top or bottom.

Figure 19B:
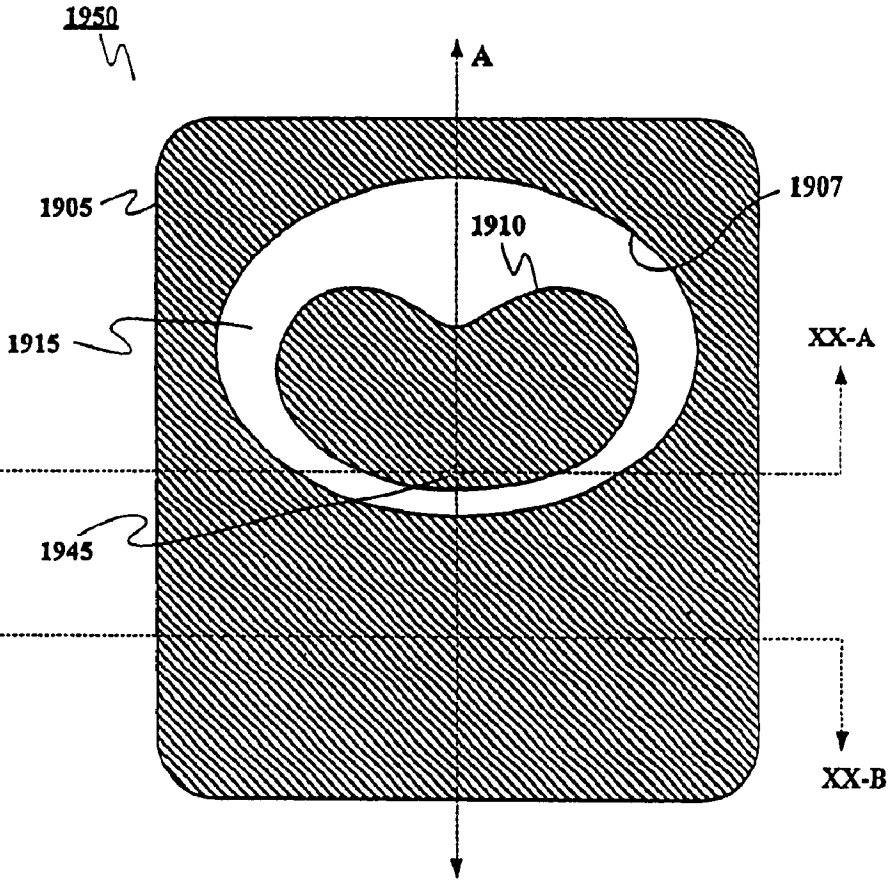
FIGS. 19A and 19B are plan views of an antenna according to yet another preferred embodiment of the present invention.
Figure 19A:
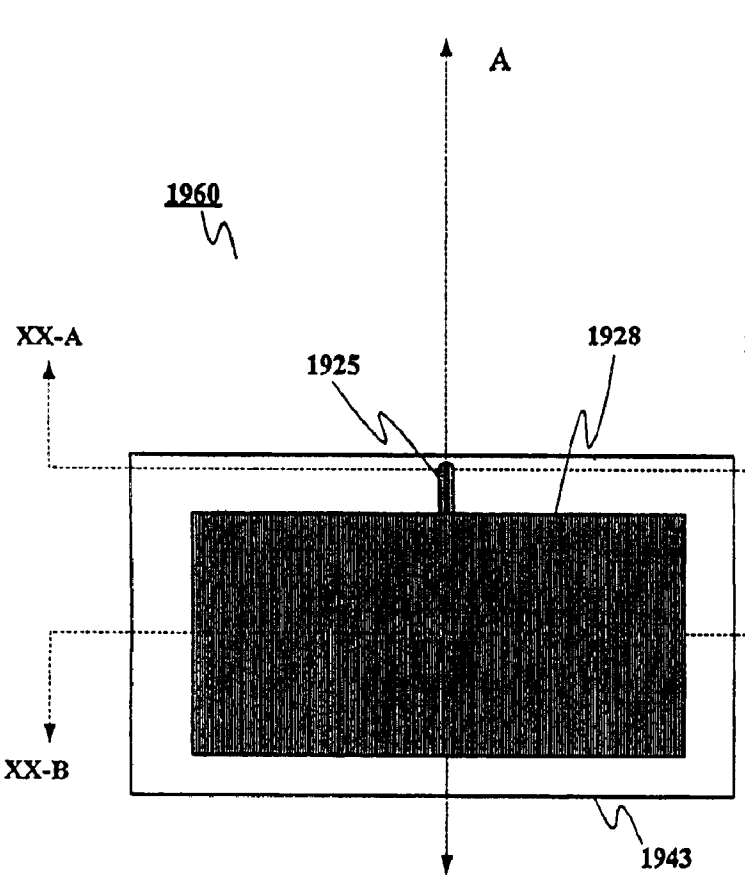
Figure 20A:
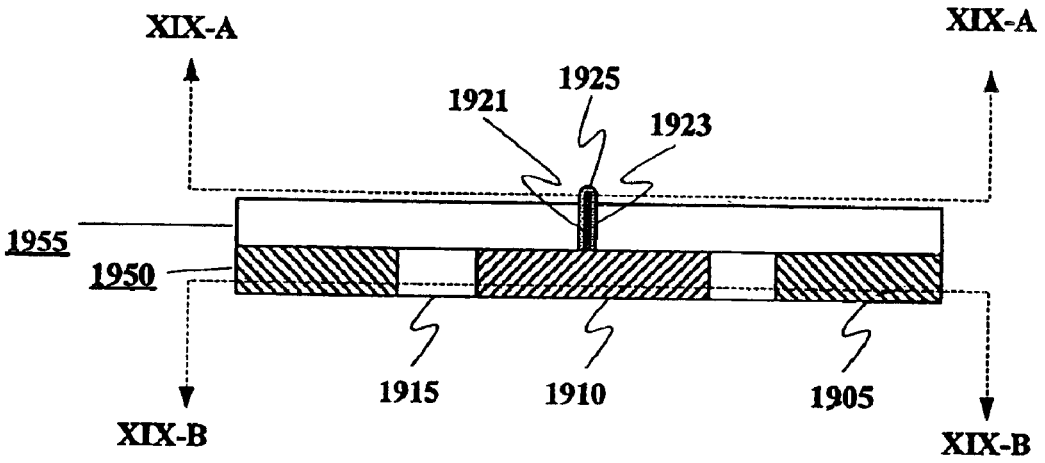
FIGS. 20A and 20B are cutaway views of the antennas shown in FIGS. 19A and 19B.
Figure 20B:
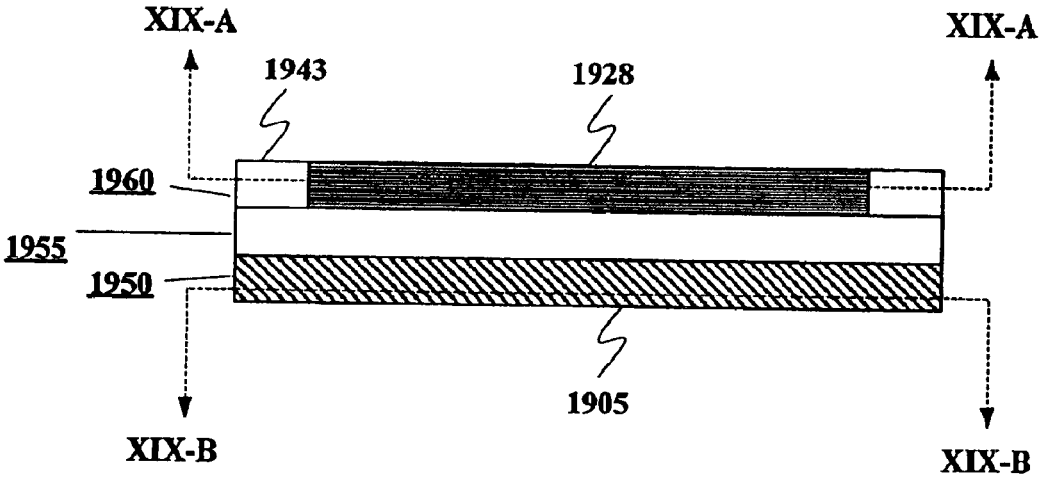

FIGS. 19A and 19B are overhead views of the layers of an antenna according to a preferred embodiment of the present invention using a magnet wire as a transmission line to connect the antenna to a circuit attached directly to the antenna. FIGS. 20A and 20B are cutaway views of the antenna of FIGS. 19A and 19B. FIG. 19A corresponds to the cutaway arrows XIX-A in FIGS. 20A and 20B; FIG. 19B corresponds to the cutaway arrows XIX-B in FIGS. 20A and 20B; FIG. 20A corresponds to the cutaway arrows XX-A in FIGS. 19A and 19B; and FIG. 20B corresponds to the cutaway arrows XX-B in FIGS. 19A and 19B.

As shown in FIGS. 19A to 20B, the antenna of this embodiment includes three separate layers: a first circuit layer 1950, a second circuit layer 1960, and an insulating layer 1955. The first circuit layer 1950 and the insulating layer 1955 are preferably about the same size and shape, and the second circuit layer 1960 is preferably smaller than either the first circuit layer 1950 or the insulating layer 1955. A transmission line 1925 passes over the portion of the insulating layer 1955 not covered by the second circuit area 1960.

The first circuit layer 1950 includes a ground element 1905, a driven element 1910, and a tapered clearance area 1915; and the second circuit layer 1960 includes a circuit board 1928. The insulating layer 1955 includes a transmission via 1980 located over the driven element 1910.

The transmission line 1925 is preferably a magnet wire or other similar wire. The magnet wire includes a metal core 1921 surrounded by an insulating material 1923, and such wires are well known in the art. The transmission line 1925 connects the circuit board 1928 to the driven element 1910 through the transmission via 1980.

In the first circuit layer 1950 the ground element 1905 is formed with a cutout section having an inner circumference 1907 that is a simple closed curve. The driven element 1910 is also a simple closed curve and has a circumference that is less than the inner circumference 1907 of the ground element 1905. The driven element 1910 is formed inside of the cutout section to define a tapered clearance area 1915 between the ground element 1905 and the driven element 1910.

This clearance area 1915 is preferably formed such that it is symmetrical around an axis of symmetry A, having a narrow portion at one end and a wide portion at the other end. Preferably the clearance area 1915 is tapered such that a clearance width between the driven element and the ground element is monotonically nondecreasing as it passes from the narrow portion to the wide portion.

At one end the transmission line 1925 connects to the driven element 1910 through the transmission via 1980 at a connection point 1945 proximate to the narrow portion of the clearance area 1915. At the other end the transmission line 1925 connects to the circuit board 1928.

Although this embodiment shows the transmission via 1980 being filled with the magnet wire that forms the transmission line, alternate embodiments may provide alternate connections. For example, the transmission via could be filled with a conductive material as in the embodiment of FIGS. 12A and 12B. In this case the conductive material in the transmission via would connect to the driven element 1910 at the connection point 1945 and the transmission line 1925 (i.e., the magnet wire) would connect to the conductive material in the transmission via 1980.

The ground element 1905 and the driven element 1910 are preferably formed from a conductive material, e.g., copper. The insulating layer 1955 is preferably formed out of a non-conductive material such as FR-4, Teflon, fiberglass, air, or any other suitable insulating material. The tapered clearance area 1915 is also preferably non-conductive, but can be formed out of FR-4, Teflon, fiberglass, or any other suitable insulating material or can simply be open air.

Although the second circuit layer 1960 is shown as forming the top layer and the first circuit layer 1950 is shown as forming the lower layer, the particular orientation of these layers is not important. Variations on the orientation of the layers are possible, with either one being on top or bottom.

The embodiments above are provided by way of example and not limitation. Numerous modifications are possible to the present invention. For example, the shape of the driven element and the cutout of the ground element can be varied significantly. An important restriction in these altered designs is that the width of the tapered clearance area cannot decrease as it moves from the narrowest point (i.e., the feed point) to the widest point. In addition, the tapered clearance area should preferably remain symmetrical around an axis of symmetry, unless an asymmetrical beam pattern is desired.

In other alternate embodiments the relative placement of the ground element, driven element, and transmission line can be varied. For example, all three could be coplanar, any two could be coplanar, with the other on a different plane; or all three could be formed on different planes. Where no transmission line is provided coplanar to the ground element, the inner circumference of the cutout section of the ground element can be a simple closed curve. Similarly, where no transmission line is provided coplanar to the driven element, the circumference of the driven element can also be a simple closed curve.

In addition, alternate embodiments for the transmission line can be employed. For example, a coaxial cable could be used in place of the magnet wire as a transmission line. In one such embodiment the center conductor of the coaxial cable could be connected (with the smallest length line that is mechanically possible) to the driven element at the feed point in some embodiments the coaxial cable can be routed along the lower edge of the antenna, on top of, and connected to the antenna ground area, and brought out to the side where the fields are smaller and less likely to couple to the shield of the coaxial cable.

However, there are other alternatives for the feed to the driven element. For example, sensitive UWB receiver amplifiers and/or transmitter amplifiers can be placed in the ground area and connected directly to the feed points, where the amplifier ground is connected to the ground, and the amplifier input (or output) can be connected to a driven element. This placement allows the amplifiers to connect directly to the antenna terminals without a directly connected transmission line. Such placement minimizes or eliminates transmission line losses as well as the aforementioned ringing problems. It is recognized by one of ordinary skill in the art that other drive configurations, such as slotline and aperture coupling can also be used.

To obtain even greater isolation on the shield of the coaxial cable, a ferrite bead can be secured to the coaxial cable.

Alternate embodiments of the UWB antenna according to this invention can have an amplifier of a receiver and/or transmitter mounted on the same substrate as the antenna. The amplifier can have an input connected to the driven element and an output connected to a co-planar transmission line, e.g., a metal line, magnet wire, coaxial cable, etc. Furthermore, the amplifier can have has a ground terminal connected to the ground element By integrating the transmitter and receiver circuits (i.e., through the amplifier) into the antenna, there is virtually no transmission line. Therefore, there is no attenuation loss, no dispersion, and no ringing. DC power is fed through the connecting transmission line to power the amplifier.

Figure 21:
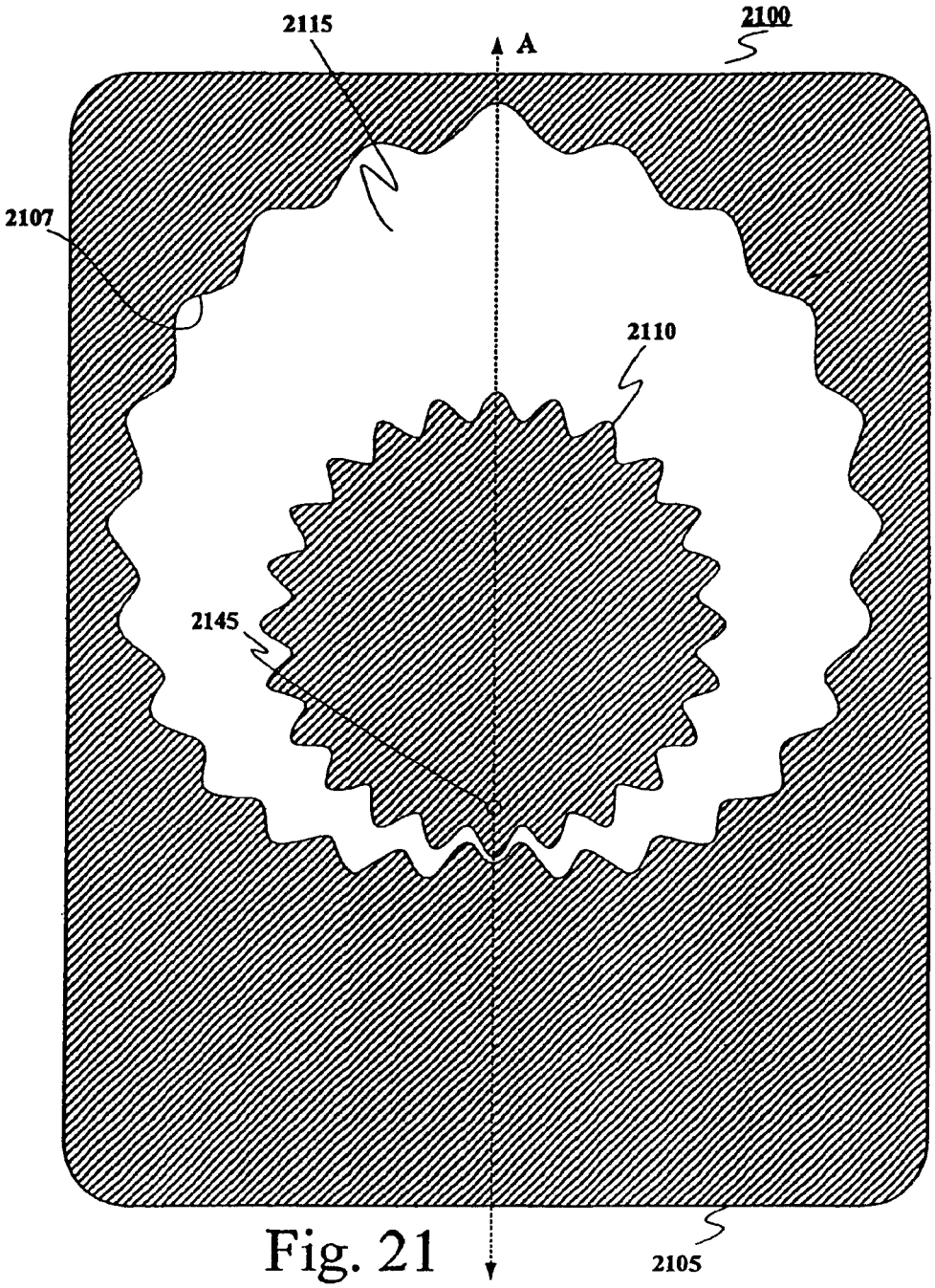
FIG. 21 is a plan view of an antenna according to still another preferred embodiment of the present invention.

In addition, although all of the embodiments above are shown to be ovals or modifications of ovals, this is by no means a requirement Variations in shape and size are possible. FIG. 21 shows one example of an antenna 2100 that uses an irregular shape for the driven element and cutout of the ground element As shown in FIG. 21, the antenna 2100 includes a ground element (i.e., a ground plane) 2105, a driven element 2110, a tapered clearance area 2115 between the ground element 2105 and the driven element 2110, and a connection point 2145. In this embodiment the ground element 2105, the driven element 2110, and the tapered clearance area 2115 are symmetrical around an axis of symmetry A that passes through the connection point 2145.

In this embodiment the ground element 2105 has a wavy cutout section having an inner circumference 2107, and the driven element 2110 has a similar wavy shape whose circumference is smaller in size than the cutout section of the ground element 2105. However, despite the irregular shape of both the cutout section of the ground element 2105 and the driven element 2110, the tapered clearance area 2115 is continually increasing in width as you pass from the narrowest point (preferably the feed point) to the widest point. This may be modified in alternate embodiments, however, when specific transfer functions such as band-stop are desired. In such cases, the width of the tapered clearance area 2115 may be adjusted accordingly.

The various other elements of the antenna 2100 not shown in FIG. 21 can be inferred based on FIGS. 1–20 and the associated disclosure.

In particular, a more irregular shape such as the one shown in FIG. 21 is used to increase the total circumference of the driven element and therefore increase the distance that an incoming or outgoing signal will travel between the driven element and the ground element. This embodiment allows greater control over the transfer function and VSWR versus the frequency.

Figure 22:
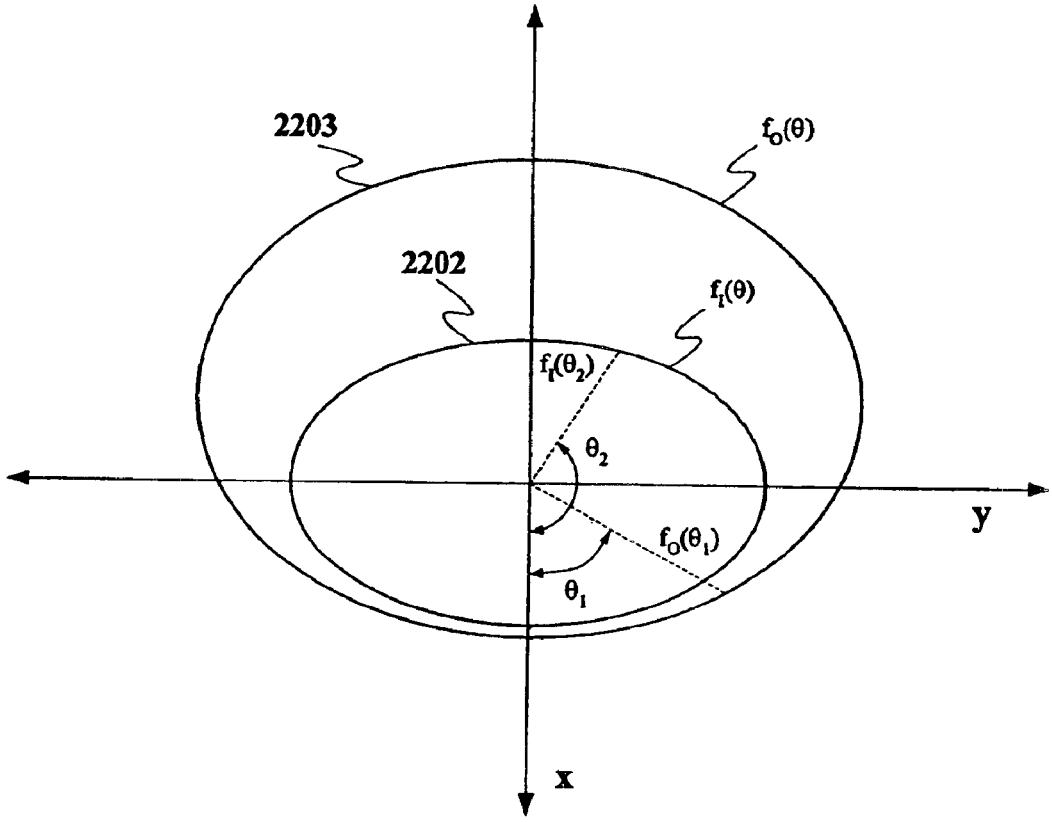
FIG. 22 is a graph showing lines that define a cutout for a ground element and a driven element using polar coordinates according to a preferred embodiment of the present invention.

In mathematical terms it is easiest to consider the ground element, the driven element, and the tapered clearance area using polar coordinates. FIG. 22 shows a graph defining the tapered clearance area using polar coordinates.

For the sake of this discussion the inner edge of the tapered clearance area 2202 (i.e., the circumference of the driven element) will be defined by the equation $f_1(\theta)$, and the outer edge of the tapered clearance area 2203 (i.e., the shape of the cutout region in the ground element) will be defined by the equation $f_0(\theta)$. The origin of the polar coordinates will be set at the geometric center of the driven element.

The equation for $f_1(\theta)$ can be considered the sum of a number of simpler equations. For example, $f_1(\theta)$may be written as the sum of k exponentials as follows:

$$f_j(\theta) = \mathrm{Re}\left(h\sum_{n=0}^{N_1} c_n e^{-jg\cdot\theta\cdot\pi}\right) \tag{1}$$

where $N_1$ is an integer, h is a size scaling term, $c_n$ is a complex coefficient for the $k^{th}$ term, which coefficient may be $-1 \leqq |c_n| \leqq 1$, and g is a shape scaling term, and $j=\sqrt{-1}$.

The parameters are chosen such that the function does not have a cusp for any value of θ between θ and π, and does not have multiple values for any value of θ between 0 and π. In graphical terms this means that the line formed by the equation $f_1(\theta)$ (i.e., the circumference of the driven element) cannot have any points or hooks.

The equation for $f_0(\theta)$ (i.e., the inner circumference of the cutout portion of the ground element) is determined by adding the width of the tapered clearance area at a given angle to the equation $f_1(\theta)$. Since the width of the tapered clearance area $W_{TCA}$ is never zero, but is always some minimum width, the width of the tapered clearance area $W_{TCA}$ for a given angle θ is determined as follows:

$$W_{TCA}=\beta+h\cdot g(\theta) \tag{2}$$

where β is a constant that defines the minimum width of the tapered clearance area at the feed point, and g(θ) is a formula that is generally "S" shaped, monotonically increasing for values of θ between 0 and π, and has a zero slope at θ=0 and θ=π.

As with $f_1(\theta)$, the equation for g(θ) can be determined as a sum of individual parts. One example of g(θ) as follows:

$$g(\theta) = a_0(e^{a\theta} - 1) + \sum_{n=1}^{N_2} a_n\theta^n + \mathrm{Re}\left(\sum_{n=0}^{N_3} e^{-jd\cdot\theta\cdot n}\right) \tag{3}$$

where $N_2$ and $N_3$ are integers, α is a first shape scaling term, d is a second shape scaling term, and an is $a_n$ complex coefficient for the $n^{th}$ term, which coefficient may be $-1 \leqq |\alpha_n| \leqq 1$, and $j=\sqrt{-1}$.

Thus, the formula for the inner circumference of the cutout portion of the ground element is as follows:

$$f_0(\theta)=\beta+h\cdot g(\theta)+f_1(\theta) \tag{4}$$

The equations $f_1(\theta)$ and $f_1(\theta)$ are preferably symmetric around the line formed at the angles of 0 and π. If they are not and are only useful between 0 and π, then the following symmetry equations can supply the other half:

$$f_1((-\theta)=f_1(\pi-\theta) \tag{5}$$

$$f_0(-\theta)=f_0(\pi-\theta) \tag{6}$$

The desire for the near zero slope can be expressed mathematically as:

$$f_1'(\theta)\approx 0, \text{ when } \theta=\pi, \text{ and } \theta=0; \text{ and} \tag{7}$$

$$g'(\theta)\approx 0, \text{ when } \theta=\pi, \text{ and } \theta=0. \tag{8}$$

And given equation (4), this means that $$f_0'(\theta)\approx 0, \text{ when } \theta=\pi \tag{9}$$

In other words, the slopes of $f_1(\theta)$ and $f_0(\theta)$ are zero with respect to the origin. Since the functions $f_1(\theta)$ and $f_0(\theta)$ are symmetric around the line that travels from 0 to π, this means that there will be no discontinuity where the two halves of $f_1(\theta)$ and $f_0(\theta)$ meet Rather, the two halves will meet at either end along contiguous lines.

The antennas shown in FIGS. 1–22 can be formed by any way that provides the desired layers and elements within the layers. A preferred method of fabrication involves the use of boards that comprise an insulating material with two layers of conductive material on either side. During fabrication the two conductive layers are etched as needed to provide the desired circuit layers, and any vias are made in the insulating material of the boards. Then the two boards are sealed together, e.g., using an insulating glue.

In alternate embodiments different fabrication techniques can be used. For example, boards formed of an insulating material with a conductive layer on a single side can be used if two separate conductive layers are not required. Or a single board with one or two conductive layers could be used if a second insulating layer is not needed. The layers could also be fabricated one on top of another using known fabrication techniques.

Figure 23:
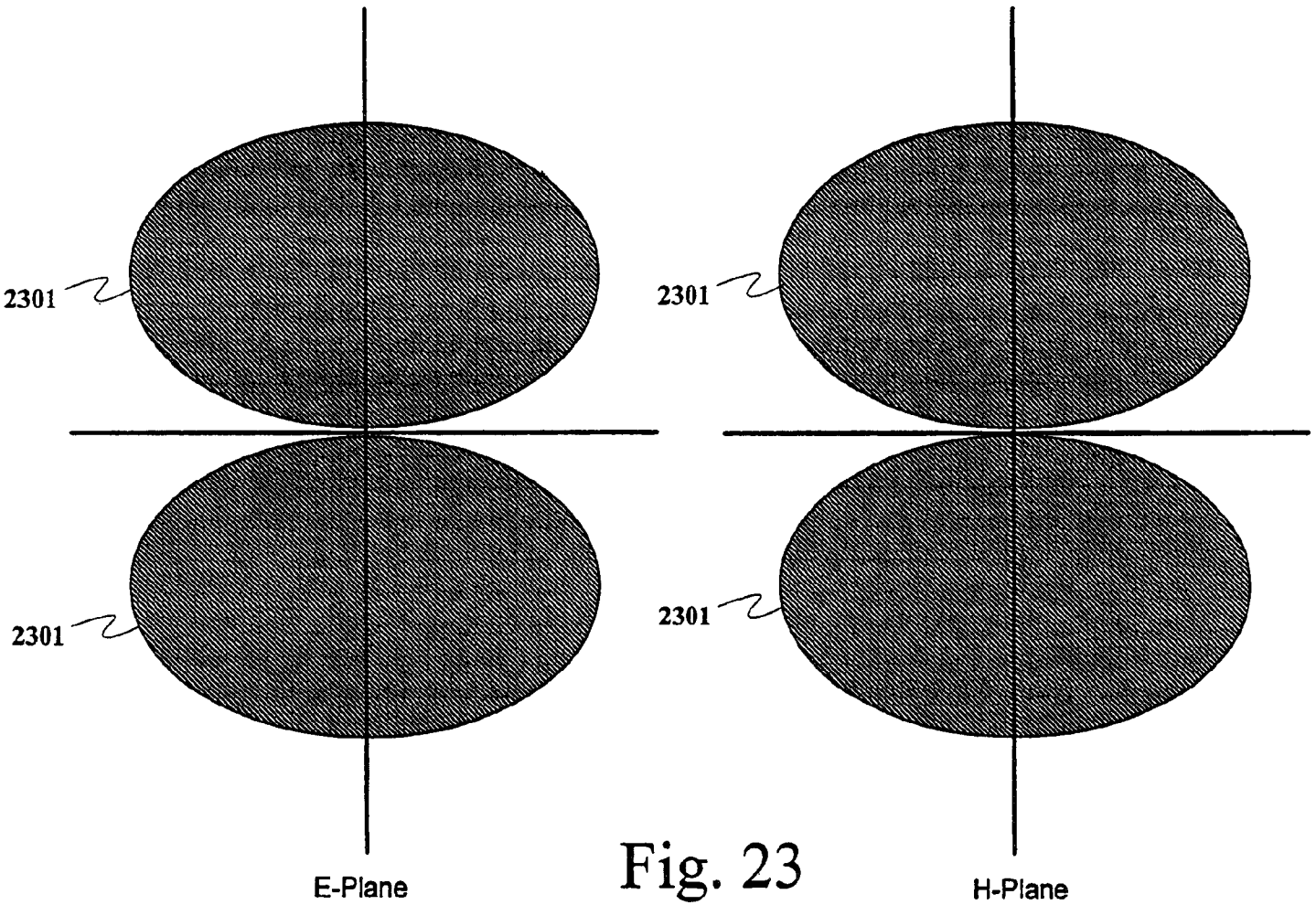
FIG. 23 is a diagram of general E-plane and H-plane radiation pattern shapes associated with the UWB antenna of FIG. 1, which show that there is no radiation in the plane of the substrate and that maximum radiation occurs perpendicular to the substrate for the fundamental EM mode.

FIG. 23 shows the E-plane and H-plane beam pattern shapes of the antenna of FIG. 1. The pattern in both planes is similar to the E-plane pattern of a dipole, with nulls at the sides and the main beams 2301 orthogonal to the nulls. The main beams 2301 are perpendicular to the plane of the antenna 100. The radiation nulls lie in the plane of the substrate. This characteristic advantageously permits arraying of the antenna 100 with low element-to-element mutual interaction.

To those of ordinary skilled in the art, and in light of the present description, the disclosed antenna illustrated in FIGS. 1–22, shows that an extremely high performance UWB antenna, transmitter, and receive front end system can be integrated onto a low-cost PC board.

These embodiments of the present invention allow for a simple, cost-effective UWB antenna that exhibits a flat response and flat phase response over ultra wide bandwidths. The techniques described herein provide several advantages over prior approaches to designing UWB antennas. The various embodiments of the present invention provide an electrically small planar UWB antenna that can be arrayed on a single substrate. The UWB antenna includes a tapered, "doughnut" shape clearance area within a sheet of conductive material. (e.g., copper), in which the feed is across the clearance area. A ground element has a cutout section that is defined by the outer edge of the clearance area. A driven element, which is situated in the clearance area, is defined by the inner edge of the clearance area. The clearance area width is tapered to increase as a function of the distance from the feed point The clearance area width, as well as the shape of the driven element, has an axis of symmetry about the feed point. The antenna can be fed by connecting a transmission line to the feed point such that the shield (or ground) of the transmission line is connected to the ground at the edge of the clearance area, and the center conductor of the transmission line is connected to the driven element also at the edge of the clearance area.

Although several embodiments are specifically illustrated and described herein, it will be appreciated that many modifications and variations of the present invention are possible in light of the above teachings and within the purview of the appended claims without departing from the spirit and intended scope of the invention.

What is claimed is:

1. An antenna device having ultra wide bandwidth (UWB) characteristics, comprising:

a ground element having a cutout section with an inner circumference, the inner circumference having a first shape; and a driven element with an outer circumference having a second shape, the driven element being smaller in size than the cutout section and being situated within the cutout section to define a clearance area between the driven element and the ground element, wherein the first shape is a first simple closed curve having no cusps, including a plurality of first concave portions and a plurality of first convex portions, wherein the second shape is a second simple closed curve having no cusps, including a plurality of second concave portions and a plurality of second convex portions, wherein the first and second shapes are formed such that any radial line from the center point of the driven element will intersect the first shape at a single first intersection point, and will intersect the second shape at a single second intersection point, a distance on the radial line between the first and second intersection points being defined as a clearance width between the driven element and the ground element for the radial line, and wherein the clearance area is tapered such that a clearance width between the driven element and the ground element is monotonically nondecreasing from a minimum clearance width to a maximum clearance width.

2. An antenna device, as recited in claim 1, further comprising a transmission line for providing an electrical signal to the driven element.

3. An antenna device, as recited in claim 2, wherein the transmission line is connected to a driven element at a feed point proximate to the minimum clearance width of the clearance area.

4. An antenna device, as recited in claim 2, wherein the transmission line comprises a metal layer.

5. An antenna device, as recited in claim 2, wherein the transmission line comprises a magnet wire.

6. An antenna device, as recited in claim 2, wherein the transmission line comprises a coaxial cable.

7. An antenna device, as recited in claim 2, wherein the transmission line is not coplanar with either the driven element or the ground element.

8. An antenna device, as recited in claim 1, wherein the clearance area is filled with one of FR-4, Teflon, fiberglass, or air.

9. An antenna device, as recited in claim 1, wherein the ground element and the driven element comprise a conductive material.

10. An antenna device, as recited in claim 9, wherein the conductive material is copper.

11. An antenna device, as recited in claim 1, wherein the first and second shapes are the same, except in different scale.

12. An antenna device, as recited in claim 1, wherein the driven element has an axis of symmetry about a line that passes between the minimum clearance width of the clearance area and the maximum clearance width of the clearance area.

* * * * *